US007914345B2

(12) United States Patent
Bopp et al.

(10) Patent No.: US 7,914,345 B2
(45) Date of Patent: Mar. 29, 2011

(54) ELECTRICAL CONNECTOR WITH IMPROVED COMPENSATION

(75) Inventors: Steven Richard Bopp, Jamestown, NC (US); Paul John Pepe, Clemmons, NC (US); Sheldon Easton Muir, Whitsett, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 38 days.

(21) Appl. No.: 12/190,920

(22) Filed: Aug. 13, 2008

(65) Prior Publication Data

US 2010/0041278 A1 Feb. 18, 2010

(51) Int. Cl.
*H01R 24/00* (2006.01)

(52) U.S. Cl. ..... 439/676

(58) Field of Classification Search ..... 439/676, 439/941, 955, 65, 79, 188; 174/258; 361/766
See application file for complete search history.

(56) References Cited

U.S. PATENT DOCUMENTS

| | | | | |
|---|---|---|---|---|
| 5,362,257 | A | 11/1994 | Neal et al. | |
| 5,975,960 | A | 11/1999 | Fogg et al. | |
| 5,997,358 | A | 12/1999 | Adriaenssens et al. | |
| 6,096,980 | A | 8/2000 | Ferry | |
| 7,179,131 | B2 | 2/2007 | Caveney et al. | |
| 7,186,149 | B2 * | 3/2007 | Hashim | 439/676 |
| 7,341,493 | B2 | 3/2008 | Pepe et al. | |
| 7,364,470 | B2 * | 4/2008 | Hashim | 439/676 |
| 7,381,098 | B2 | 6/2008 | Hammond, Jr. et al. | |
| 2008/0090468 | A1 | 4/2008 | Reeves et al. | |

* cited by examiner

*Primary Examiner* — Alexander Gilman

(57) ABSTRACT

An electrical connector including an array of conductors having at least one differential pair of conductors that extends between a mating end and a loading end of a housing. The conductors are configured to engage a selected mating contact of a mating connector at a mating interface. The electrical connector also includes a plurality of traces that extend between the mating and loading ends. Each trace is electrically connected to a corresponding conductor proximate to the mating end and/or the loading end. Also, the electrical connector includes a first interconnection, path formed by the conductors that extends from the mating interface to the loading end and a second interconnection path formed by the traces that extends from the mating interface to the loading end. The differential pair transmits current that is split, between the first and second interconnection paths where at least one interconnection path provides compensation.

25 Claims, 15 Drawing Sheets

ELECTRICAL CONNECTOR WITH IMPROVED COMPENSATION

BACKGROUND OF THE INVENTION

The subject matter herein relates generally to electrical connectors, and more particularly, to electrical connectors that utilize differential pairs and experience offending crosstalk and/or return loss.

The electrical connectors that are commonly used in telecommunication system, such as modular jacks and modular plugs, may provide interfaces between successive runs of cable in such systems and between cables and electronic devices. The electrical connectors may include contacts that are arranged according to known industry standards, such as Electronics Industries Alliance/Telecommunications Industry Association ("EIA/TIA")-568. However, the performance to the electrical connectors may be negatively affected by, for example, near-end crosstalk (NEXT) loss and/or return loss. Accordingly, in order to improve the performance of the connectors, techniques are used to provided compensation for the NEXT loss and/or to improve the return loss. Such known techniques have focused on arranging the contacts with respect to each other within the electrical connector and/or introducing components to provided the compensation e.g., compensating NEXT. For example, the compensating signals may be created by crossing the conductors such that a coupling polarity between the two conductors is reversed or the compensating signals may be created by using discrete components.

One known technique is described in U.S. Pat. No. 5,997,358 ("the '358 Patent"). The patent discloses a connector that introduces predetermined amounts of compensation between two pairs of conductors that extend from its input terminals to its output terminals along interconnection paths. Electrical signals on one pair of conductors are coupled onto the other pair of conductors in two or more compensation stages that are time delayed with respect to each other. However, the connector in the '358 Patent uses a single interconnection path which may afford only a limited effect on the electrical performance.

Thus, there is a need for alternative techniques to improve the electrical performance of the electrical connector by reducing crosstalk and/or by improving return loss.

BRIEF DESCRIPTION OF THE INVENTION

In one embodiment, an electrical connector that is configured to engage a mating connector having mating contacts and transmit a signal therebetween is provided. The electrical connector includes a housing having a mating end and a loading end. The electrical connector, also includes an array of conductors that have at least one differential pair of conductors that extends between the mating end and the loading end of the housing. The conductors are configured to engage a selected mating contact of the mating connector at the mating interface, and each conductor transmits a signal current. The electrical connector also includes a plurality of traces that extend between the mating and loading ends. Each trace is electrically connected to a corresponding conductor proximate to at least one of the mating end and the loading end. Also, the electrical connector includes a first interconnection path formed by the conductors that extends from the mating interface to the loading end and a second interconnection path formed by the traces that extends from the mating interface to the loading end. The signal current transmitting through at least one conductor of the at least one differential pair is split between the first and second interconnection paths. Also, at least one of the first and second interconnection paths is configured to provide compensation.

Optionally, the signal current may be split asymmetrically between the first interconnection path and the second interconnection path. The conductors may be configured to provide only one NEXT compensation stage along the first interconnection path. Also, the traces may be configured to provide a plurality of NEXT compensation stages along the second interconnection path where the NEXT compensation stages do not reverse in polarity.

In another embodiment, an electrical connector that is configured to engage a mating connector having mating contacts and transmit a signal therebetween is provided. The electrical connector includes a housing that has a mating end and a loading end. The electrical connector also includes an array of conductors forming at least one differential pair of conductors that extends between the mating end and the loading end within the housing. The conductors are configured to engage a selected mating contact at a mating interface and transmit a signal current. The electrical connector also includes a circuit board assembly having a circuit board disposed within the housing between the mating end and the loading end. The board assembly includes a plurality of traces that extend along the circuit board, where at least one trace is electrically connected to a corresponding conductor proximate to the mating end. The board assembly also includes a connecting member that extends from the circuit board. The connecting member electrically connects the trace to the corresponding conductor proximate to the loading end.

DETAILED DESCRIPTION OF THE INVENTION

Figure 1:
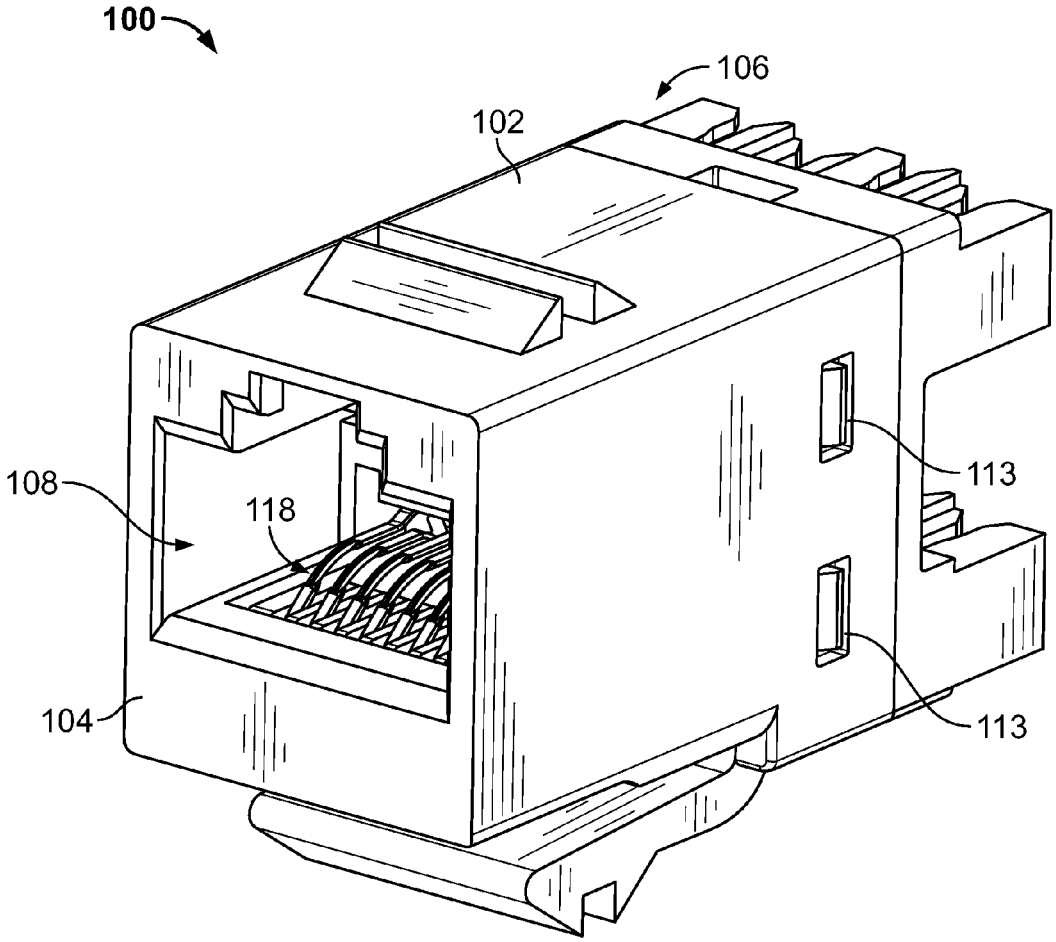
FIG. 1 is a perspective view of an electrical connector formed in accordance with one embodiment of the present invention.

FIG. 1 is a perspective view of an electrical connector 100 formed in accordance with one embodiment. As shown, the electrical connector 100 is a modular jack, such as an RJ-45 jack assembly, that is configured to engage a mating connector or modular plug 145 (shown in FIG. 5), and transmit data and/0r power therebetween. The electrical connector 100 includes a housing 102 having mating and loading ends 104 and 106, respectively, and a cavity 108 extending therebetween. When the electrical connector 100 is fully assembled, the cavity 108 is configured to receive the modular plug 145 trough the mating end 104. However, while the electrical connector 100 is shown and described with reference to an RJ-45jack assembly and a modular plug, the subject matter herein may be used with other types of connectors.

The electrical connector 100 includes a plurality of conductors 118 that are configured to interface with mating contacts 146 (shown in FIG. 5) of the modular plug 145. As will be discussed in greater detail below, in the exemplary embodiment, the electrical connector 100 is configured to split the electrical current of one or more differential signals, hereinafter referred to as "signal current," transmitting through the mating contacts 146 at a mating interface 120 (shown in FIG. 3). The signal current is split into multiple interconnection paths that are formed by conductors and/or traces. Along each interconnection path, one or more compensation mechanisms, techniques, or components may be used for reducing the negative effects of crosstalk and/or return loss. For example, in the illustrated embodiment, the electrical connector 100 uses adjacent conductors/traces that are electromagnetically coupled to each other via non-ohmic plates to improve the electrical performance of the electrical connector 100. In addition, the electrical connector 100 may reposition two conductors/traces by crossing paths of the conductors/traces in order to reverse the coupling polarity of the two. However, utilizing non-ohmic plates, open-ended traces, and crossover techniques are only examples of providing compensation in electrical connectors and they are not intended to be limiting. Those skilled in the art understand that various mechanisms, techniques, and components may be used to provide compensation and/or improve return loss.

Figure 2:
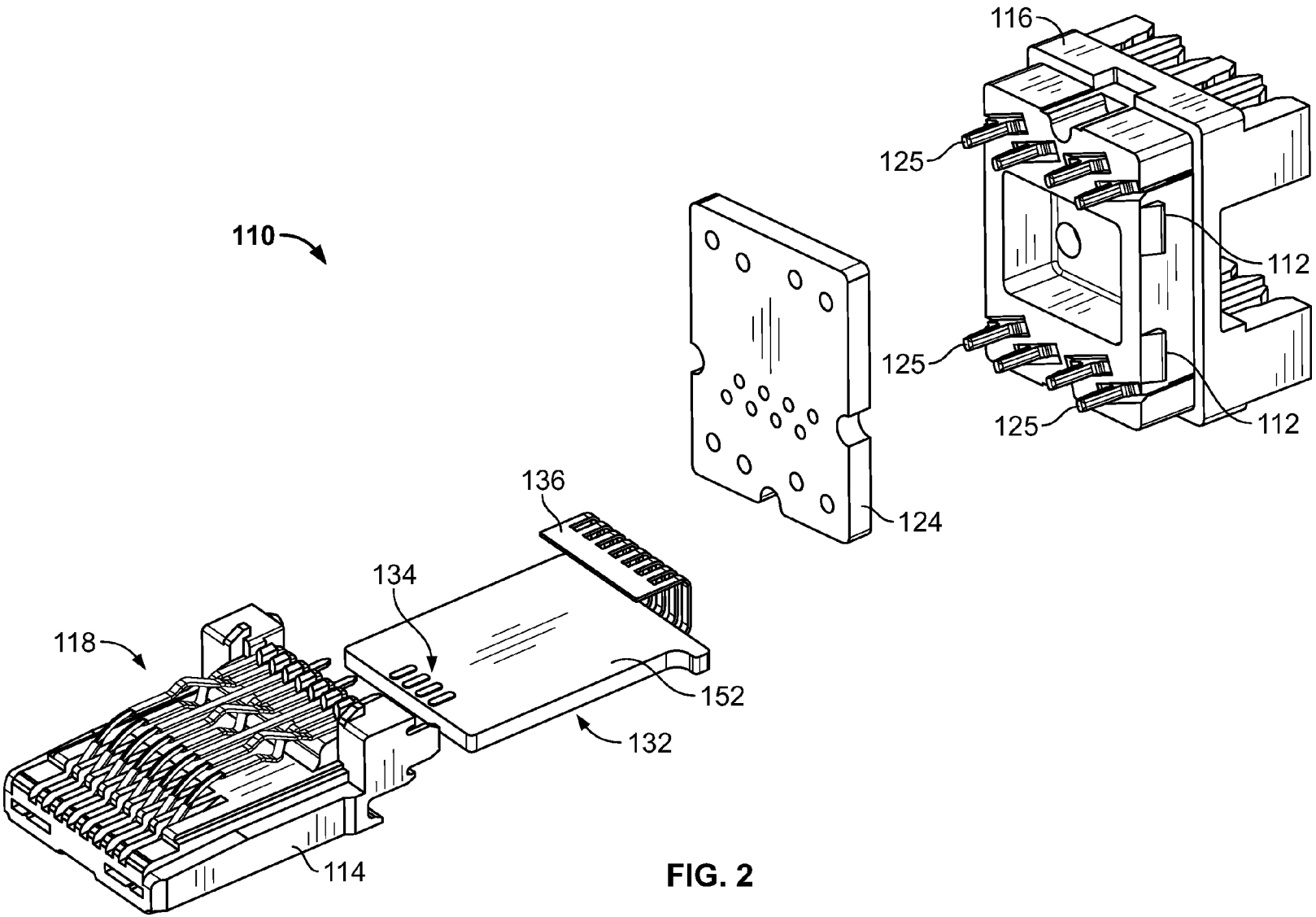
FIG. 2 is an exploded view of a contact sub-assembly that may be used with the electrical connector shown in FIG. 1.

FIG. 2 is an exploded view of a contact sub-assembly 110 that is received within the housing 102 (FIG. 1) through the loading end 106 (FIG. 1) when the electrical connector 100 (FIG. 1) is fully assembled. The contact sub-assembly 110 may include a mating assembly 114, a wire-terminating assembly 116, a circuit board assembly 132, and a circuit board 124. The board assembly 132 and the circuit board 124 are both configured to be electrically connected to the plurality, of conductors 118 disposed on the mating assembly 114. In the illustrated embodiment, the board assembly 132 includes a plurality of contact pads 134 on a surface of a circuit board 152 that are electrically connected to a connecting member 136 via a plurality of traces (discussed below). The wire-terminating assembly 116 includes a plurality of insulation displacement contacts (IDCs) 125 that extend therethrough and are configured to engage the circuit board 124. The IDCs 125 are configured to receive and connect with wires (not shown).

The circuit board 152 of the board assembly 132 is configured to be inserted into a cavity (not shown) of the mating assembly 114. The contact pads 134 may engage corresponding conductors 118 near the mating end 104 (FIG. 1) of the electrical connector 100. When the electrical connector 100 is fully assembled, the contact sub-assembly 110 is held within the housing 102. The contact sub-assembly 110 may be secured to the housing 102 by using tabs 112 that project away from sides of the contact sub-assembly 110 and are inserted into and engage corresponding windows 13 (shown in FIG. 1) within the housing 102.

Figure 3:
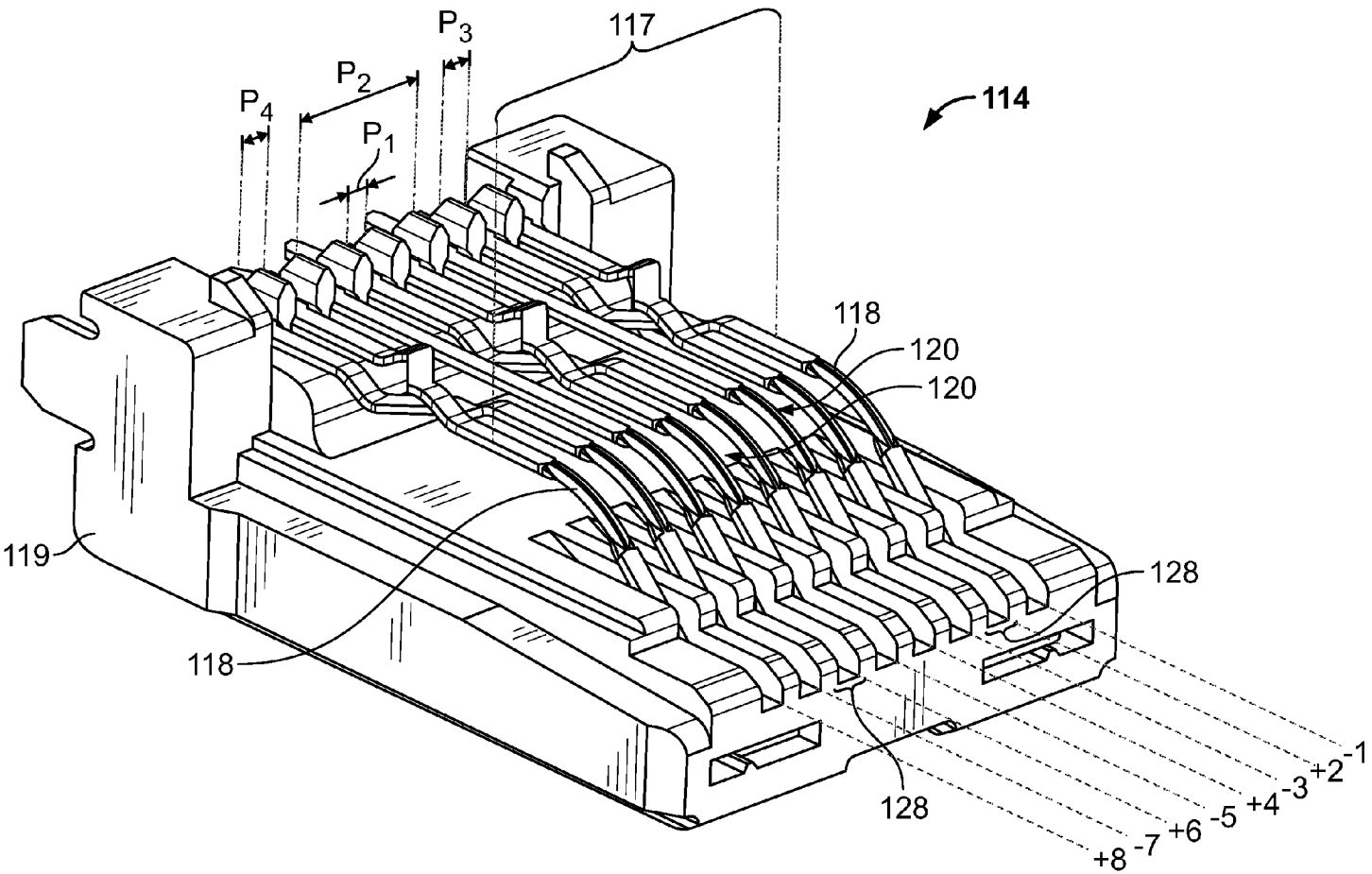
FIG. 3 is an enlarged perspective view of a mating assembly that may be used with the contact subassembly shown in FIG. 2.

FIG. 3 is an enlarged perspective view of the mating assembly 114. As shown, the mating assembly 114 may include an array 117 of the conductors 118 that are attached to or supported by a body 119. The configuration of the array 117 of conductors 118 may be controlled by industry standards, such as EIA/TIA-568. As shown, the array 117 includes eight conductors 118 that are arranged as a plurality of differential pairs P1-P4. Each differential pair P1-P4 consists of two associated conductors 118 in which one conductor 118 transmits a signal current and the other conductor 118 transmits a signal current that is 180° out of phase with the associated conductor. In the exemplary embodiment, the array 117 of conductors 118 may have an EIA/TIA-568 A modular jack wiring configuration for a typical RJ45 connector. More specifically, the differential pair P1 includes conductors +4 and −5; the differential pair P2 includes conductors +6 and −3; the differential pair P3 includes conductors +2, and −1; and the differential pair P4 includes conductors +8 and −7. As used herein, the (+) and (−) represent polarity of the conductors. Accordingly, a conductor labeled (+) is opposite, in polarity to a conductor labeled (−) and, as such, the conductor labeled (−) carries a signal that is 180° out of phase with the conductor labeled (+).

As shown in FIG. 3, the conductor +6 and the conductor −3 of the differential pair P2 are separated by the conductors +4 and −5 that form the differential pair P1. As such, near-end crosstalk (NEXT) may develop between the differential pairs P1 and P2.

In alternative embodiments, the array 117 of conductors 118 may have other wiring configurations. For example, the array 117 may be configured under the EIA/TIA-568B modular jack wiring configuration. As such the illustrated configuration of the array 117 is not intended to be limiting.

Figure 5:
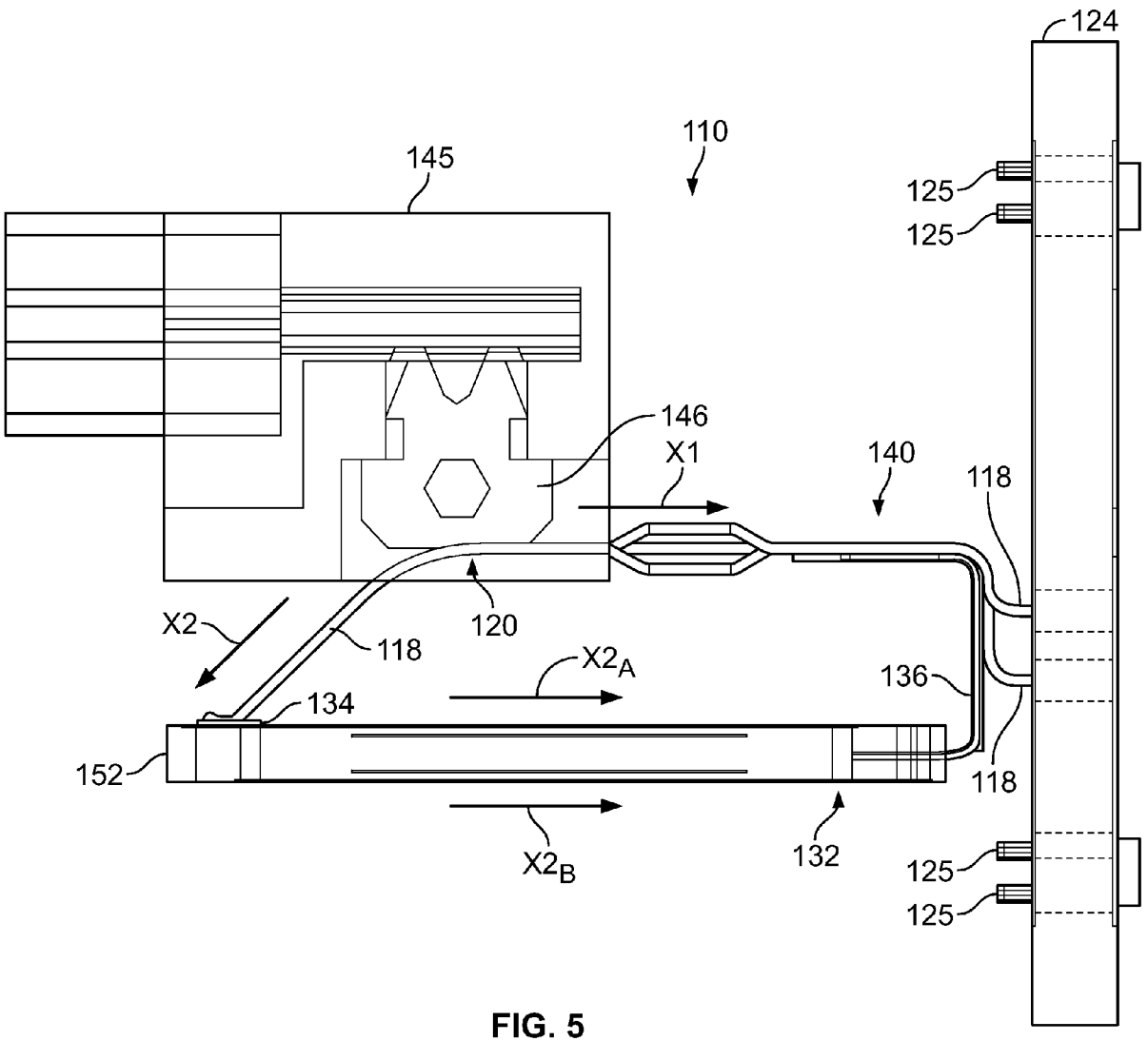
FIG. 5 is a schematic side view of a portion of the electrical connector shown in FIG. 1 when the electrical connector engages a modular plug.

Also shown, the body 119 may include a plurality of slot openings 128. Each of the conductors 118 includes a mating interface 120 and is configured to extend into a corresponding slot opening 128 such that portions of the conductors 118 are received in corresponding slot openings 128. The body 119 may form gaps or holes (not shown) that allow the conductors 118 to be electrically connected to the contact pads 134 (FIG. 2). The conductors 118 may be movable within the slot openings 128 to allow flexing of the conductors 118 as the electrical connector 100 (FIG. 1) is mated with the modular plug 145 (FIG. 5). Furthermore, each of the conductors 118 may extend substantially parallel to one another and the mating interfaces 120 of each conductor 118 may be generally aligned with one another.

When the electrical connector 100 is assembled, the mating interfaces 120 are arranged within the cavity 108 (FIG. 1) to engage the corresponding mating contacts 146 (FIG. 5) of the modular plug 145. When the conductors 118 are engaged with the corresponding mating contacts 146 of the modular plug 145, the conductors 118 may bend or flex into the contact pads 134 of the board assembly 132 (FIG. 2) to make an: electrical connection and form an electrical path. Alternatively, the conductors 118 may be configured to engage or connect with the contact pads 134 even when the modular plug 145 is not engaged with the electrical connector 100.

Figure 4:
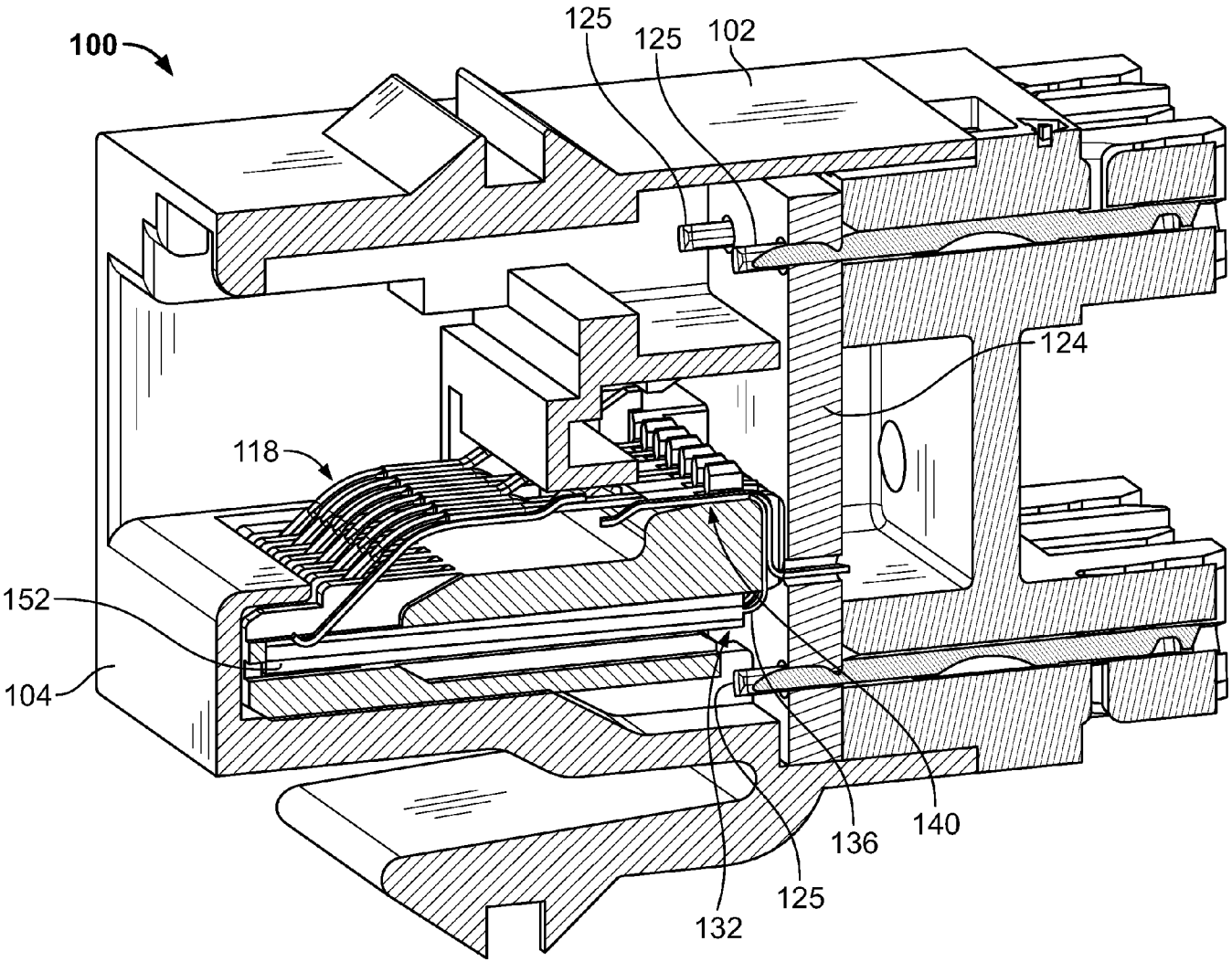
FIG. 4 is a perspective cross-sectional view of the electrical connector shown in FIG. 1.

FIG. 4 is a cross-sectional view of the fully assembled electrical connector 100, and FIG. 5 is a schematic side view of a portion of the electrical connector 100 when engaged with the modular plug 145 and shows a portion of the contact sub-assembly 110. When assembled, the circuit board 152 of the board assembly 132 is positioned within the housing 102 (FIG. 4) such that the conductors 118 engage the contact pads 134 (FIG. 5). The circuit board 124 may be oriented vertically within the housing 102 such that the circuit board 124 is substantially perpendicular to, and spaced apart a predetermined distance from, the circuit board 152 of the board assembly 132. The circuit board 124 may facilitate connecting the conductors 118 to the IDCs 125. Furthermore, the board assembly 132 may be positioned generally forward of the circuit board 124, in the direction of the mating end 104 (FIG. 4). However, the positions of the circuit board 124 and the circuit board 152 are only exemplary, and the circuit board 124 and the circuit board 152 may be positioned, anywhere within the hosing 102 in alternative embodiments.

Also shown, a connecting member 136 extends from the board assembly 132 and curves upward to engage the conductors 118 at corresponding nodes 140. In the exemplary embodiment, an end of the connecting member 136 is embedded within the circuit board 152 of the board assembly 132 and extends therefrom. However, in alternative embodiments, the connecting member 136 may be coupled to one of the surfaces of the board assembly 132 using, for example, an adhesive. As will be discussed in greater detail below, the connecting member 136 facilitates electrically connecting traces within the board assembly 132 to corresponding conductors 118 at the nodes 140.

With reference to FIG. 5, when the mating contacts 146 engage the conductors 118 at the corresponding mating interfaces 120, offending signals that cause noise/crosstalk may be generated. The offending crosstalk (also called NEXT loss) is created by adjacent or nearby conductors through capacitative and inductive coupling which yields the exchange of electromagnetic energy between conductors. In the illustrated embodiment, signal current transmitted between the mating end 104 (FIG. 1) and the loading end 106 (FIG. 1) is split so that a first current portion is transmitted through a first interconnection path X1 and a second current portion is transmitted through a second interconnection path X2. An "interconnection path," as used herein, is formed by conductors and/or traces of a differential pair that are configured to transmit a signal current between input and output terminals when the electrical connector is in operation. In the illustrated embodiment, the signal current flowing through the differential pair P2 is split between the interconnection paths X1 and X2 and the signal current flowing through the differential pair P1 only flows along the interconnection path X1. However, in alternative embodiments, more than one differential pair can be split into multiple interconnection paths. Furthermore, although the arrows shown in FIG. 5 for interconnection paths X1 and X2 are in one direction, those skilled in the art understand that a communication jack is bi-directional.

Optionally, techniques for providing compensation may be used along any interconnection path, such as reversing the polarity of the conductors/traces. Also, non-ohmic plates and discrete components, such as, resistors, capacitors, and/or inductors may be used along the interconnection path for providing compensation.

Also shown, the interconnection path X2 may later split into a plurality of interconnection paths, such as interconnection paths $X2_A$ and $X2_B$, which are secondary to the interconnection path X2. However, embodiments described herein are not intended to be limiting. For example, each interconnection path may be split into secondary interconnection paths and one or more of the secondary interconnection paths may be split into tertiary interconnection paths, etc. Also, an interconnection path may not only be split into two interconnection paths, such as with interconnection paths $X2_A$ and $X2_B$, but may be split into three or more interconnection paths.

By way of example, each differential pair P1, P2, P3, and P4. (FIG. 3) transmits signal current along the first interconnection path X1 from the corresponding mating interface 120 to a corresponding node 140 and to the output terminals through IDC's 125. Additionally, in the exemplary embodiment, the conductors +6 and −3 of differential pair P2 and conductors +4 and −5 of differential pair P1 are each electrically connected to corresponding traces (discussed below) of the board assembly 132 through corresponding contact pads 134. The traces that are electrically connected to the conductors +6 and −3 extend from the corresponding contact pads 134 through the board assembly 132 and through corresponding connecting members 136 to electrically connect to corresponding nodes 140 and to the output terminals through IDC's 125. Thus in one embodiment, the electrical connector 100 includes the interconnection path X1 that extends from the mating interfaces 120 through the array 117 of conductors 118 to nodes 140 and to the output and the interconnection path X2 that extends from the mating interfaces 120 through the traces of the board assembly 132 to the nodes 140 and to the output terminals through IDC's 125.

As shown in the exemplary embodiment, each interconnection path X1 and X2 may include one or more NEXT stages. A "NEXT stage," as used herein, is a region where signal coupling (i.e., crosstalk) exists between conductors or pairs of conductors and where the magnitude and phase of the crosstalk are substantially similar, without abrupt change. An interconnection path may have multiple NEXT stages within it. Also, the NEXT stage could be a NEXT loss stage, where offending signals are further generated, or a NEXT compensation stage, where NEXT compensation is provided. For purposes of analysis, the average crosstalk along each NEXT stage may be represented by a vector whose phase is measured at the midpoint of the NEXT stage. This does not apply to the initial offending crosstalk generated at the mating interface node 120 (FIG. 5), which is represented by a vector whose phase is zero. In one embodiment, NEXT compensation for the NEXT loss generated at the mating interface 120 (FIG. 3) is only provided by the board assembly 132 and the conductors 118 (i.e., not within the circuit, board 124). However, those skilled in the art understand that NEXT compensation may be generated with the circuit board 124 if desired.

Furthermore, in one embodiment, the interconnection path X2 has a higher impedance than the interconnection path X1 such that a larger portion of the signal current travels through the interconnection path X1. Accordingly, embodiments described herein may sustain larger amounts of power without overheating than previously known electrical connectors.

Figure 6A:
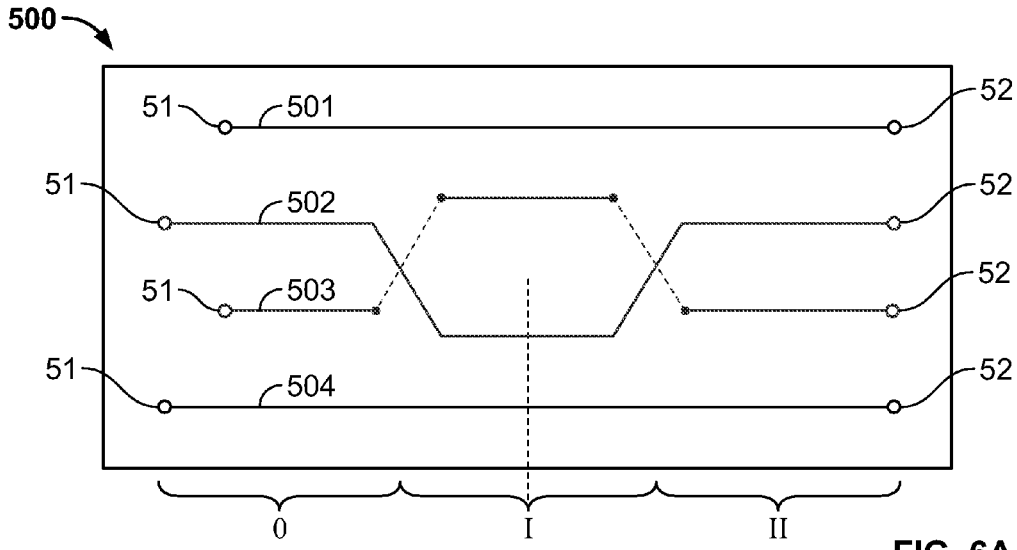
FIG. 6A (Prior Art)
FIG. 6A schematically illustrates one prior known technique that includes multiple stages for providing compensation along one interconnection path.
Figure 6B:
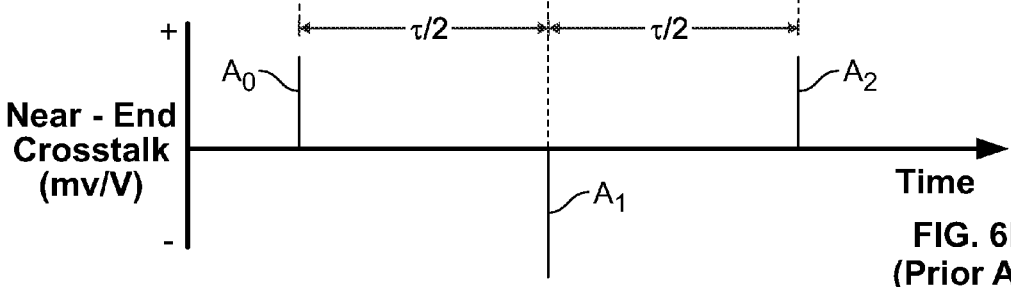
FIG. 6B (Prior Art)
FIG. 6B illustrates polarity and magnitude for the stages shown in FIG. 6A as a function of transmission time delay.
Figure 6C:
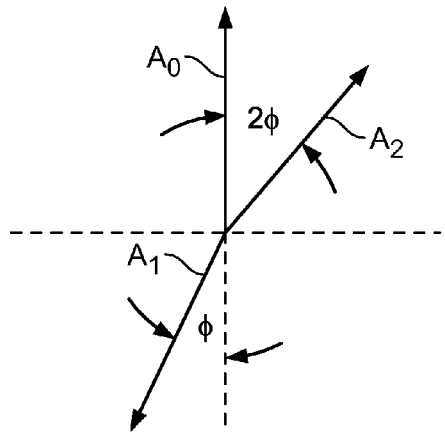
FIG. 6C (Prior Art)
FIG. 6C illustrates a polarity and magnitude vector diagram of the technique shown in FIGS. 6A and 6B in complex polar notation.

FIGS. 6A-6C illustrate one known technique that is described in the '358 Patent for creating compensation crosstalk in an electrical connector. As shown in FIG. 6A, conductors 501-504 extend between input terminals 51 and output terminals 52 of connecting apparatus 500. The conductors 501 and 504 form one wire pair that straddles another wire pair formed by the conductors 502 and 503.

FIG. 6B graphically illustrates the crosstalk between the two pairs along a time axis. The vector $A_0$, generated in stage 0, represents the offending crosstalk (NEXT loss). As shown in FIG. 6A, compensation is provided by crossing conductor 502 over the path of conductor 303 so that the polarity of the crosstalk between the conductor pairs is reversed. Accordingly, stage I provides compensating crosstalk, $A_1$, i.e., the crosstalk has a polarity opposite to the polarity of the offending crosstalk $A_0$ in stage 0. As shown in FIG. 6B, the magnitude of $A_1$ is approximately twice the magnitude of $A_0$. Stage II is another compensation stage that provides further compensating crosstalk, $A_2$, that is shown having the same approximate magnitude of crosstalk as the offending crosstalk $A_0$, but an opposite polarity with respect to stage I. By selecting the crossover locations and the amount of signal coupling between the conductors 501-504, the magnitude and phase of vectors $A_0$, $A_1$, and $A_2$ (illustrated in FIG. 6C) can be selected to approximately cancel each other. As shown in FIGS. 6A-6C and as known in the prior art, the offending crosstalk and compensating crosstalk for each wire pair are provided on a single interconnecting path.

As is understood by the inventors, the signal coupling or crosstalk that occurs along the stages 0, I, and II shown in FIGS. 6A-6C may be written in complex polar notation as vectors $\vec{A}_o$, $\vec{A}_1$, and $\vec{A}_2$. The initial crosstalk is defined by the vector $\vec{A}_0$ shown in the following equation:

$$\vec{A}_0=|A_0|e^{i\phi is\ 0}=|A_0| \quad \text{(Equation 1)}$$

where $|A_0|$ is the complex magnitude and $e^{i\Phi_0}$ is the complex phase shift relative to the offending NEXT in $\vec{A}_0$. The phase shift for $\vec{A}_0$ is $\phi_0=0$. The compensating crosstalk generated in stage I is represented by the complex vector and the compensating crosstalk in stage II is represented by the complex vector $\vec{A}_2$.

In order for stages I and II to cancel out the offending crosstalk or NEXT loss generated by $\vec{A}_0$, the vector sum of $\vec{A}_1$ and $\vec{A}_2$ should be approximately equal to $\vec{A}_0$. Furthermore, if additional stages are used, all of the vectors that represent offending or compensating crosstalk that occurs along the interconnection path after stage 0 should all be summed to be approximately equal to $\vec{A}_0$. Thus, if $\phi_2-2\phi_1$, an equation may be made that generally represents an electrical connector using multiple NEXT stages with alternating polarity as shown above:

$$|A_0| \approx -\sum_{n=1}^{N}(-1)^n|A_n|e^{i\phi_n} \quad \text{(Equation 2)}$$

where "N" equals the total number of stages.

As will discussed in greater detail below, the electrical connector 100 (FIG. 1) uses multiple NEXT stages to effectively reduce or cancel the offending crosstalk $\vec{A}_0$. However, the electrical connector 100 splits the signal current between multiple interconnection paths, e.g., X1 and X2 which may each have one or more NEXT compensation stages. Furthermore, although the known crossover technique discussed above may be used to provide compensating crosstalk, the electrical connector 100 may use other means of providing compensation. For example, the interconnection paths X1 and X2 may include non-ohmic plate and/or discrete components, such as resistors, capacitors, and inductors to facilitate providing compensation.

Figure 7:
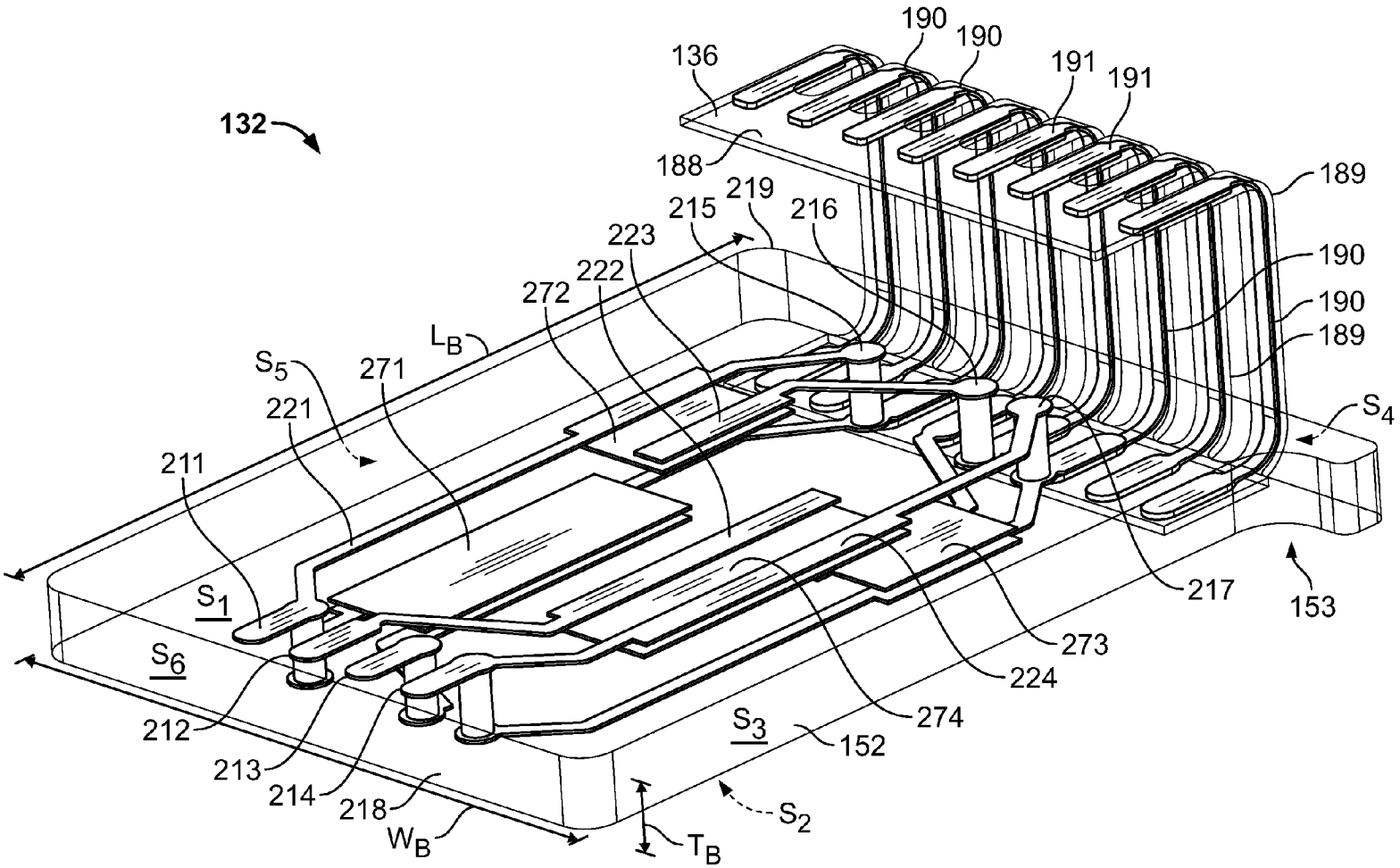
FIG. 7 is a top-perspective view of a circuit board assembly used with the electrical connector shown in FIG. 1.
Figure 8:
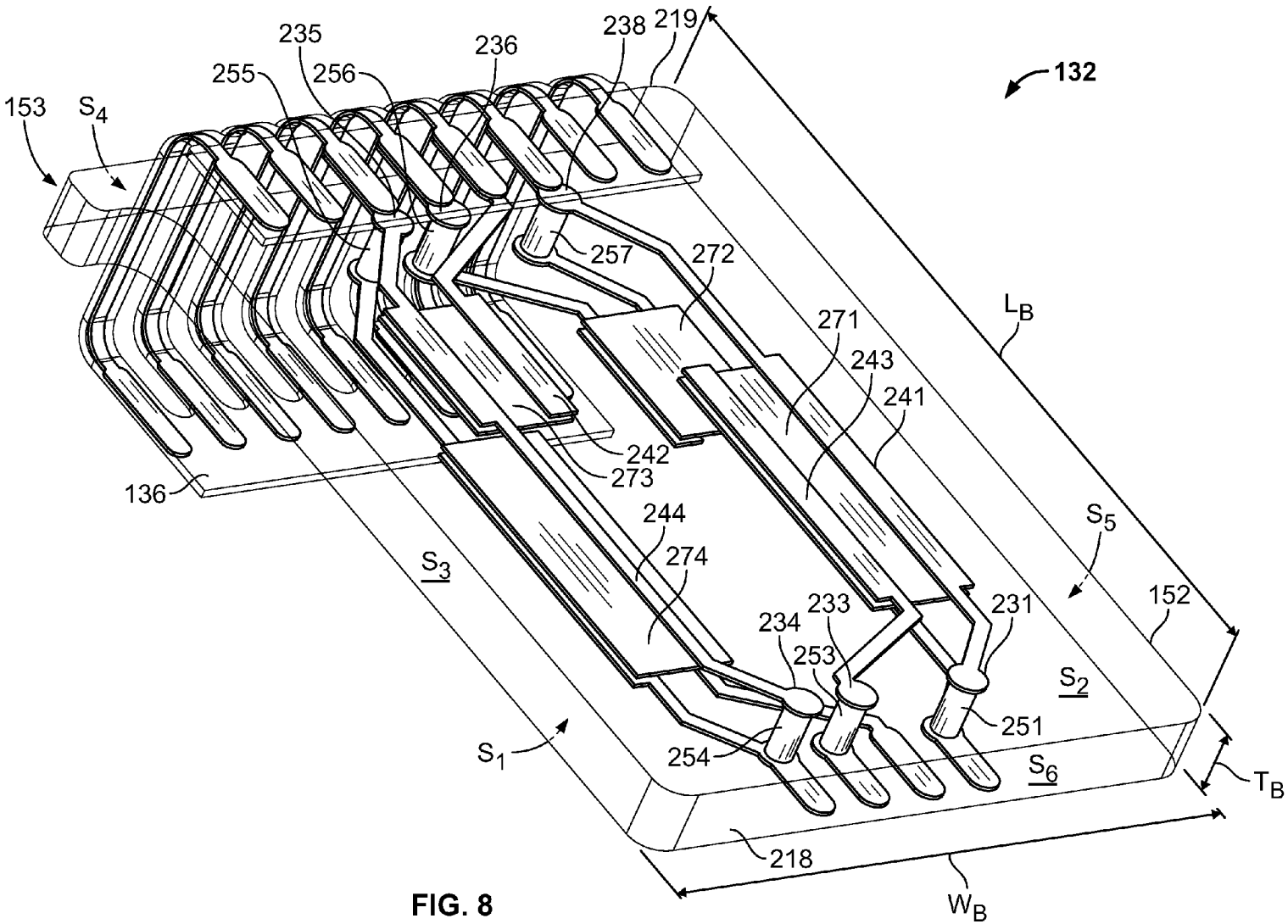
FIG. 8 is a bottom-perspective view of the circuit board assembly shown in FIG. 7.

FIGS. 7 and 8 are top and bottom perspective views, respectively, of the board assembly 132 coupled to the connecting member 136. In the exemplary embodiment, the board assembly 132 is configured to provide one or more stages of compensation for the electrical connector 100 using, for example, traces and non-ohmic plates. As used, herein, the term "non-ohmic plate" refers to a conductive plate that is not directly connected to any conductive material, such as traces or ground. In one embodiment, the non-ohmic plates may be positioned relative to one or more open-ended traces and/or one or more contact traces within the circuit board. As used herein, the term "open-ended traces" refers to traces that do not carry a signal current when the electrical connector 100 is operational. As used herein, the term "contact trace" is a trace that extends between two points and carries a signal current therebetween. When in use, the non-ohmic plate may electromagnetically couple, i.e., magnetically and/or capacitatively couple, to the open-ended and/or contact traces. As such, the non-ohmic plate and corresponding traces may be configured to provide compensation.

In alternative embodiments, the open-ended and contact traces may electromagnetically couple and provide compensation without using a non-ohmic plate. For example, the contact traces may extend adjacent to each other and crossover, similar to that described above in FIGS. 6A-6C. Also, the distances separating the adjacent traces, whether open-ended or contact traces, may be narrowed or widened in order to affect the electromagnetic coupling. Discrete capacitors defined by piezoelectric fingers may also be used to provide compensation.

As shown in FIGS. 7 and 8, the board assembly 132 includes the circuit board 152. The circuit board 152 may be formed from a dielectric material and may be substantially rectangular and have a length $L_B$, a width $W_B$, and a substantially constant thickness $T_B$. Alternatively, the circuit board 152 may be other shapes. The circuit board 152 may be formed from multiple layers. The circuit board 152 may also include a protruded portion 153. As shown, the circuit board 152 includes a plurality of outer surfaces $S_1$-$S_6$, including a top surface, $S_1$, a bottom surface $S_2$, and side surfaces $S_3$-$S_6$. The top and bottom surfaces $S_1$ and $S_2$, respectively, are on opposite sides of the circuit board 152 and are separated by the thickness $T_B$. Opposing side surfaces $S_4$ and $S_6$ are separated by the length $L_B$; and opposing side surfaces $S_3$ and $S_5$ are separated by the width $W_B$.

As shown in FIG. 7, the surface $S_1$ may include a plurality of contact pads 211-214 and trace pads 215-217. The contact pads 211-214 may be aligned with respect to each other and proximate to a mating end 218 of the board assembly 132 such that the contact pads 211-214 are proximate to the mating end 104 (FIG. 1) when the connector is fully assembled. The trace pads 215-217 may be aligned with respect to each other and proximate to a rear end 219, which may be proximate to the loading end 106 (FIG. 1). Also shown, the surface $S_1$ may include a plurality of traces 221-224 thereon. Each trace 221-224 extends from a corresponding contact pad or trace pad. More specifically, traces 221, 222, and 224 may extend from contact pads 211, 212, and 214, respectively. The traces 221 and 224 are contact traces and extend lengthwise from the contact pads 211 and 214, respectively, toward the rear end 219 and couple to a trace pad 215 and 217, respectively. The trace 222 is open-ended and extends lengthwise from the contact pad 212 toward the rear end 219 and terminates at a position on the surface $S_1$ and adjacent to the trace 224. The trace 223 is open-ended and extends lengthwise from the trace pad 216 toward the mating end 218 and terminates at a position on the surface $S_1$ and adjacent to the trace 221.

With respect to FIG. 8, the surface $S_2$ may include a plurality of trace pads 231, 233, and 234 positioned near the mating end 218 and a plurality of trace pads 235, 236, and 238 positioned near the rear end 219. Each trace pad 231, 233, and 234 is connected to one of the contact pads 211, 213, and 214 (FIG. 7), respectively, through corresponding vias 251, 253, and 254, which extend; through the thickness $T_B$ proximate to the mating end 218. Likewise, each trace pad 235, 236, and 238 is connected to one of the contact pads 217, 216, and 215 (FIG. 7), respectively, through corresponding vias 255, 256, and 257. Also, the board assembly 132 includes a plurality of traces 241-244 on the surface $S_2$ that extend from corresponding trace pads. More specifically, the traces 241, 243, and 244 extend from the trace pads 231, 233, and 234, respectively, lengthwise toward the rear end 219. The trace 242 extends from the rear end 219 lengthwise toward the mating end 218. The traces 241 and 244 are contact traces and extend completely between corresponding trace pads, whereas the traces 243 and 242 are open-ended traces that terminate at a position along the surface $S_2$. The trace 243 is positioned adjacent to the trace 241, and the trace 242 is positioned adjacent to the trace 244.

As discussed above, the board assembly 132 may also include non-ohmic plates 271-274 to facilitate electromagnetic coupling adjacent traces. The non-ohmic plates 271-274 may be "free-floating," i.e., the plates do not contact either of the adjacent traces or any other conductive material that leads to one of the conductors 118 or ground. In one embodiment, the board assembly 132 may have multiple layers where the non-ohmic plates 271-274 and the traces are on separate layers. Furthermore, in the illustrated embodiment, the non-ohmic plates 271-274 are substantially rectangular; however, other embodiments may have a variety of geometric shapes. In the illustrated embodiment, the non-ohmic plates are embedded within the circuit board 152 a distance from the corresponding traces to provide broadside coupling with the traces. Alternatively, the non-ohmic plates may be co-planer (e.g., on the corresponding surface) with respect to the adjacent traces and positioned therebetween such that each trace electromagnetically couples with an edge of the non-ohmic plate.

In the exemplary embodiment, each non-ohmic plate 271-274 is positioned near adjacent traces that include one open-ended trace and one contact trace. More specifically, as shown in FIG. 8, the non-ohmic plate 271 is positioned within the circuit board 152 near the open-ended trace 243 and the contact trace 241, and the non-ohmic plate 273 is positioned within the circuit board 152 near the open-ended trace 242 and the contact trace 244. As shown in FIG. 7, the non-ohmic plate 272 is positioned within the circuit board 152 near the open-ended trace 223 and the contact trace 221, and the non-ohmic plate 274 is positioned within the circuit board 152 near the open-ended trace 222 and the contact trace 224. Although other sizes and positions may be used, in the illustrated embodiment, the non-ohmic plates 271 and 274 have a substantially equal length and are longer than the non-ohmic plates 272 and 273, and the non-ohmic plates 271 and 274 are positioned closer to the mating end 218, whereas the non-ohmic plates 272 and 273 are positioned closer to the rear end 219.

However, alternative embodiments are not limited to using non-ohmic plates to electromagnetically couple one open-ended trace to one contact trace. For instance, a non-ohmic plate may couple a plurality of open-ended traces to one or more contact traces or a non-ohmic plate may couple a plurality of contact traces to one open-ended trace. Also, a non-ohmic plate may be used to couple two or more contact traces or two or more open-ended traces. In addition, alternative embodiments may not use a non-ohmic plate.

When the electrical connector 100 is fully assembled and in operation, the conductors 118 (FIG. 3) that form differential pairs P1 and P2 (FIG. 3) are coupled to the contact pads 211-214 (FIG. 7). As such, the traces 221-224 (FIG. 7) and 241-244 (FIG. 8) are electrically connected to the conductors 118 that form the differential pairs P1 and P2. With respect to the differential pair P1, the conductor +4 and the conductor −5 electrically connect to the contact pads 213 and 212, respectively, and the open-ended traces 243 and 222, respectively, near the mating end 218. The conductors +4 and −5 are electrically connected to the open-ended traces 242 and 223, respectively, through the connecting member 136 at the rear end 219. More specifically, the conductor +4 is electrically connected to the open-ended trace 242 through a corresponding member trace 190 (discussed below) of the connecting member 136. The conductor −5 is electrically connected to the open-ended trace 223 through trace pad 216, via 256, trace pad 236, and a corresponding member trace 190 of the connecting member 136.

With respect to the differential pair P2, the conductor −3 is electrically connected to the contact pad 214 and the conductor +6 is electrically connected to the contact pad 211. Accordingly, the signal current carried by the conductor −3 is split such that a first signal current portion is directed through the contact trace 224 and a second signal current portion is directed through the contact trace 244. The signal current conveyed by the conductor +6 is split such that a first portion of the signal current is directed through the contact trace 221 and a second portion of the signal current is directed through the contact trace 241. More specifically, the conductor +6 for the differential pair P2 goes through path $X2_A$ along the contact pad 211, the contact trace 221, and the trace pad 215 and through path $X2_B$ along the trace pad 231, the contact trace 241, and the trace pad 238. The signal from the conductor −3 for the differential pair P2 goes through path $X2_A$ along the contact pad 214, the contact trace 224, the trace pad 217, and through path $X2_B$ along the trace pad 234, the contact trace 244, and the trace pad 235.

By way of example and with specific reference to adjacent traces 221 and 223 shown in FIG. 7, when the board assembly 132 is in use, electromagnetic energy may travel down the trace 221 and radiate the electromagnetic energy in the form of electric and magnetic fields that couple to the non-ohmic plate 272. The electromagnetic energy may then travel across a surface of the non-ohmic plate 272 and radiate from the plate surface to the trace 223. Thus, the board assembly 132 may use non-ohmic proximity energy coupling to compensate or reduce crosstalk between the differential pairs P1 and P2 and/or improve the return loss at a desired frequency range of interest. However, those having ordinary skill in the art will understand that an insignificant or minimal amount electromagnetic coupling may occur with other traces in the board assembly 132. As such the type, position, geometric shape, and other factors relating to these traces may be considered when designing the board assembly 132.

Also shown in FIGS. 7 and 8, the connecting member 136 extends from or is attached to the rear end 219 of the circuit board 152. In one embodiment, the connecting member 136 includes a unitary body 188 that may be constructed from a material that is more flexible than the board assembly 132. The body 188 comprises a plurality of ribs 189 mat extend away from the rear end 219 Each rib 189 may include a member trace 190 that is electrically connected to one of the traces on the board assembly 132 at one end of the member trace 190 and couples or forms into a node pad 191 at the other end of the member trace 190. The node pad 191 is configured to electrically connect with one of the conductors 118 at the corresponding node 140 (FIG. 5). As such, the traces of the board assembly 132 may be electrically connected to corresponding conductors 118 in the array 117 (FIG. 3).

FIGS. 9A-9D schematically illustrate in detail one technique for providing NEXT compensation in accordance with an exemplary embodiment of the present invention. As shown, the interconnection paths X1 and X2, have an asymmetric relationship with respect to each other. As used herein, two interconnection paths that extend in parallel to each other are "asymmetric" if one interconnection path splits into secondary interconnection paths and the other interconnection path does not, thereby generating effectively different time delays for the interconnection paths relative to each other. For example, the interconnection path X2 splits into secondary interconnection paths $X2_A$ and $X2_B$, whereas the interconnection path X1 does not. Due to the asymmetric relationship, the interconnection paths X1 and X2 will have effectively different time delays (discussed further below).

Figure 9A:
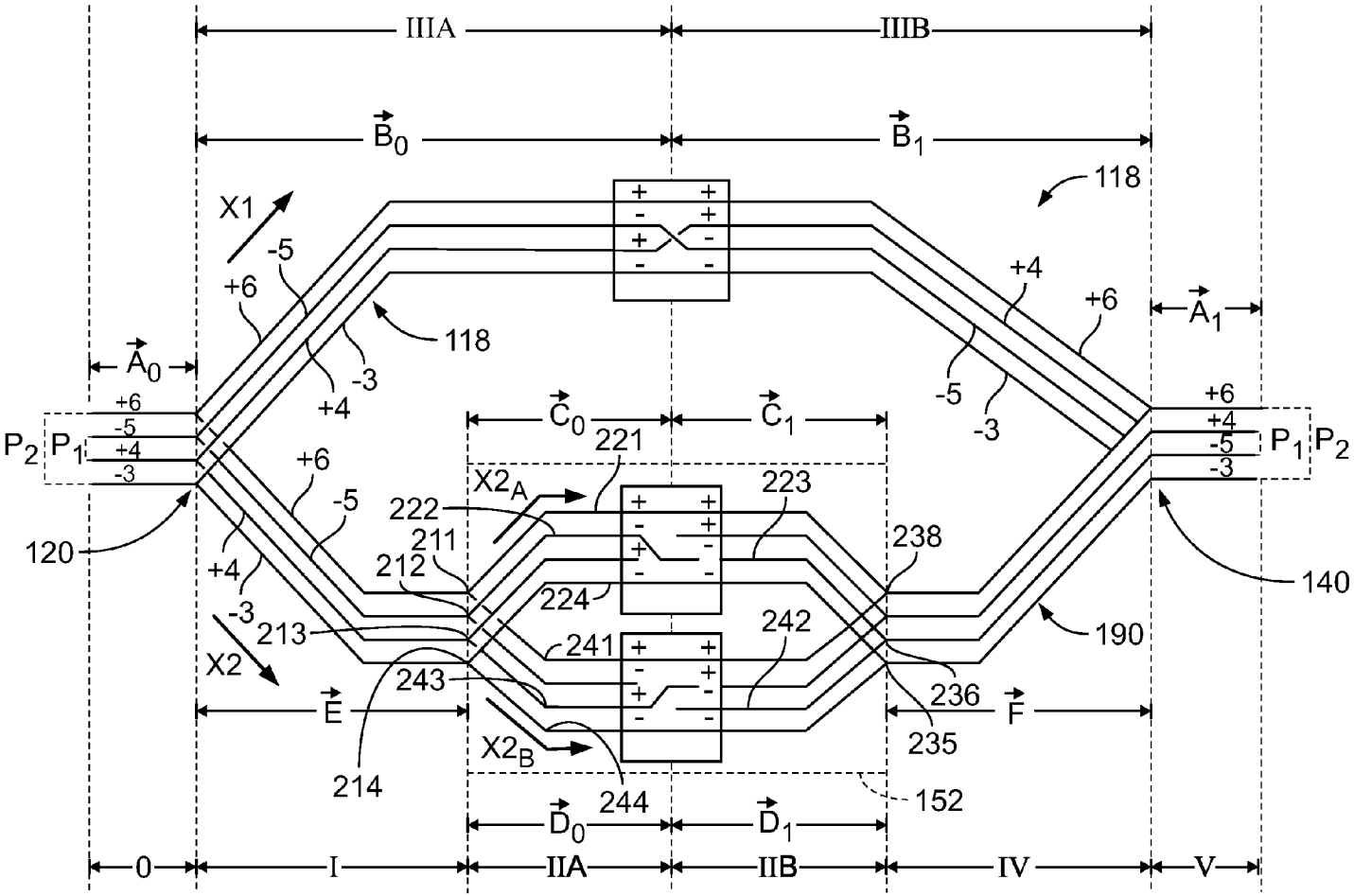
FIG. 9A illustrates an electrical schematic of a preferred embodiment of the present invention showing the associated with each stage.

FIG. 9A illustrates a schematic of the electrical configuration for interconnection paths X1 and X2. Stage 0 represents the mating interfaces 120 where the NEXT loss $\vec{A}_0$ is generated. The interconnection paths X1 and X2 split at the mating interfaces 120 and rejoin each other at the nodes 140. Alternatively, the interconnection paths X1 and X2 may split at some point after the mating interface 120. As shown, the interconnection path X1 extends along stages IIIA and IIIB through the conductors 118 of the differential pairs P1 and P2 (i.e., the conductors +4 and −5 of the differential pair P1 and the conductors −3 and +6 of the differential pair P2). While the signal current travels along the conductors 118 in stage IIIA, NEXT loss is generated. Stage IIIA continues until the conductor +4 and the conductor −5 are crossed over each other. The signal current also travels along conductors 118 in stage IIIB where NEXT compensation is generated. Stage V where the NEXT compensation $\vec{A}_1$ is generated, spans between node 140 and the IDC 125 (FIG. 5).

Although not shown, the differential pairs P3 and P4 also extend along the interconnection path X1 and include one NEXT loss stage and one NEXT compensation stage. However, in alternative embodiments, the interconnection path X1 may include more than one NEXT compensation stage and/or NEXT loss stage.

As shown in FIG. 9A, the interconnection path X2 travels along stages I, IIA, IIB, and IV. Initially, the interconnection path X2 extends from the mating interfaces 120 along the conductors 118 in a direction opposite that of the interconnection path X1. Stage I ends when the interconnection path X2 is then sub-divided at the contact pads 211 and 214 (FIG. 7) into two secondary interconnection paths $X2_A$ and $X2_B$. The secondary interconnection paths $X2_A$ and $X2_B$ extend along the circuit board 152 (FIG. 2) between the contact pads 211 and 214 and the trace pads 235and 238 (FIG. 8). The interconnection path $X2_A$ includes the contact traces 221 and 224. The interconnection path $X2_B$ includes the contact traces 241 and 244 The interconnection paths $X2_A$ and $X2_B$ are reunited at the trace pads 235 and 238. Stage IV extends from the trace pads 235and 238 along the corresponding member traces 190 of the connecting member 136 to the nodes 140 where the interconnection paths X1 and X2 for the differential pair P2 are reunited.

As shown in FIG. 9A, the conductors 118 are arranged in order as +6, −5, +4, and −3 at the mating interfaces 120. When the interconnection paths X1 and X2 are reunited at the nodes 140, the order of the conductors 118 is changed to +6, +4, −5, and −3. In the illustrated embodiment, the polarity between the conductors of the differential pair P1 is reversed only once. Other embodiments, however, may alternate the polarity multiple times.

FIG. 9A also illustrates the complex vectors associated with each NEXT stage. More specifically, the complex vector $\vec{A}_0$ represents the NEXT loss generated at stage 0, which may form the main source of NEXT loss. The complex vector $\vec{B}_0$ represents the NEXT loss generated by conductors 118 of the interconnection path X1 along stage IIIA. The complex vector $\vec{B}_1$ represents the NEXT compensation generated by the conductors 118 extending along stage IIIB. With reference to the interconnection path X2, the complex vector $\vec{E}$ (Equation 3) represents the NEXT loss generated by the conductors 118 that extend along stage I. The interconnection path X2 is then split further into secondary paths $X2_A$ and $X2_B$. The complex vector $\vec{C}_0$ represents the NEXT loss generated along the secondary path $X2_A$ and the complex vector $\vec{D}_0$ represents the NEXT loss generated along the secondary path $X2_B$. At the point between stages IIA and IIB, the polarity of the NEXT signals is effectively reversed such that NEXT compensation is now generated along the secondary path $X2_A$ and the secondary path $X2_B$, which is represented by the complex vectors $\vec{C}_1$ and $\vec{D}_1$, respectively. When the traces along the secondary path $X2_A$ and secondary path $X2_B$ are reunited, the member traces 190 continue to generate NEXT compensation along stage IV, which is represented by the complex vector $\vec{F}$ (Equation 4). Lastly, the complex vector $\vec{A}_1$, defines the NEXT compensation at stage V that is generated by the physical region that spans between node 140 and the IDC 125 (FIG. 5).

$$\vec{E}=|E|e^{i\alpha} \quad \text{(Equation 3)}$$

$$\vec{F}|F|e^{i\beta} \quad \text{(Equation 4)}$$

Figure 9B:
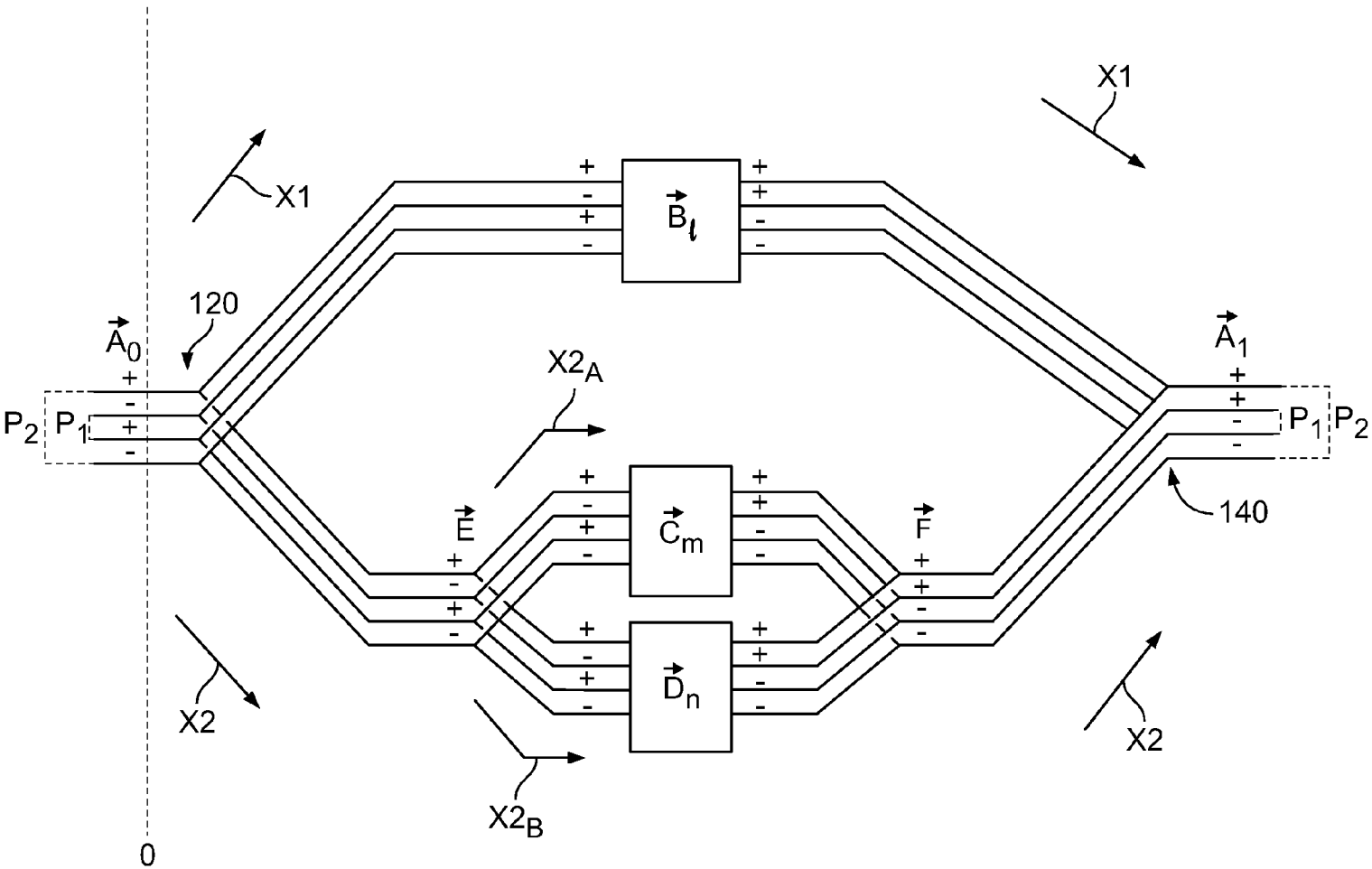
FIG. 9B illustrates a schematic of a more general configuration of the present invention.

FIG. 9B illustrates a general schematic of an electrical configuration for some embodiments of the present invention. For example, the interconnection path X1 may include more than two NEXT stages. As such, the NEXT vectors, $\vec{B}_0$, $\vec{B}_1$, and any additional complex vectors for any additional NEXT stages along the interconnection path X1 maybe defined in general by the complex vector array $\vec{B}_1$, (Equation 5).

$$\vec{B}_1=[|B_0|e^{i\gamma_0}, -|B_1|e^{i\gamma_1}, |B_2|e^{i\gamma_2}, \ldots, (-1)^1|B_1|e^{i\gamma_1}] \quad \text{(Equation 5)}$$

Similarly the NEXT vectors, $\vec{C}_0$, $\vec{C}_1$, and any additional complex vectors for any additional NEXT stages along the interconnection path $X2_A$ may be defined in general by the complex vector array $\vec{C}_m$(Equation 6), and the vectors NEXT vectors, $\vec{D}_0$, $\vec{D}_1$, and any additional complex vectors for any additional NEXT stages along the interconnection path $X2_B$ are defined in general by the complex vector array $\vec{D}_n$ (Equation 7).

$$\vec{C}_m=[|C_0|e^{i\theta_0}, -|C_1|e^{i\theta_1}, |C_2|e^{i\theta_2}, \ldots, (-1)^m|C_m|e^{i\theta_m}] \quad \text{(Equation 6)}$$

$$\vec{D}_n=[|D_0|e^{i\Psi_0}, -|D_1|e^{i\Psi_1}, |D_2|e^{i\Psi_2}, \ldots, (-1)^m|D_n|e^{i\Psi_n}] \quad \text{(Equation 7)}$$

As discussed above, the overall purpose of the stages I-V is to cancel or minimize the NEXT loss provided $\vec{A}_0$ at stage 0. However, the configuration of the electrical connector 100 is more complicated than discussed above with respect to the cross-over technique in FIGS. 6A-6C along one interconnection path. For example, in addition to the NEXT loss vector, $\vec{A}_0$, the electrical connector 100 must also consider the interface between the IDC terminals and the conductors and traces at the node 140, represented by the vector $\vec{A}_1$. Accordingly, in order to effectively cancel or minimize the NEXT loss, the electrical connector 100 is configured such that the summation of the vectors: $\vec{A}_0$, $\vec{A}_1$, $\vec{B}_1$, $\vec{C}_m$, $\vec{D}_m$, $\vec{E}$, and $\vec{F}$ is approximately equal to zero. Thus:

$$0 \approx |A_0| + |E|e^{i\alpha} + \sum_{l=0}^{L}(-1)^l|B_l|e^{i\gamma_l} + \sum_{m=0}^{M}(-1)^m|C_m|e^{i\theta_m} + \sum_{n=0}^{N}(-1)^n|D_n|e^{i\varphi_n} - |A_1|e^{i\phi_1} - |F|e^{i\beta} \quad \text{(Equation 8)}$$

where L, M, and N are equal to the maximum number of compensation vectors or stages for $\vec{B}_1$, $\vec{C}_m$ and $\vec{D}_n$, respectively.

Figure 9C:
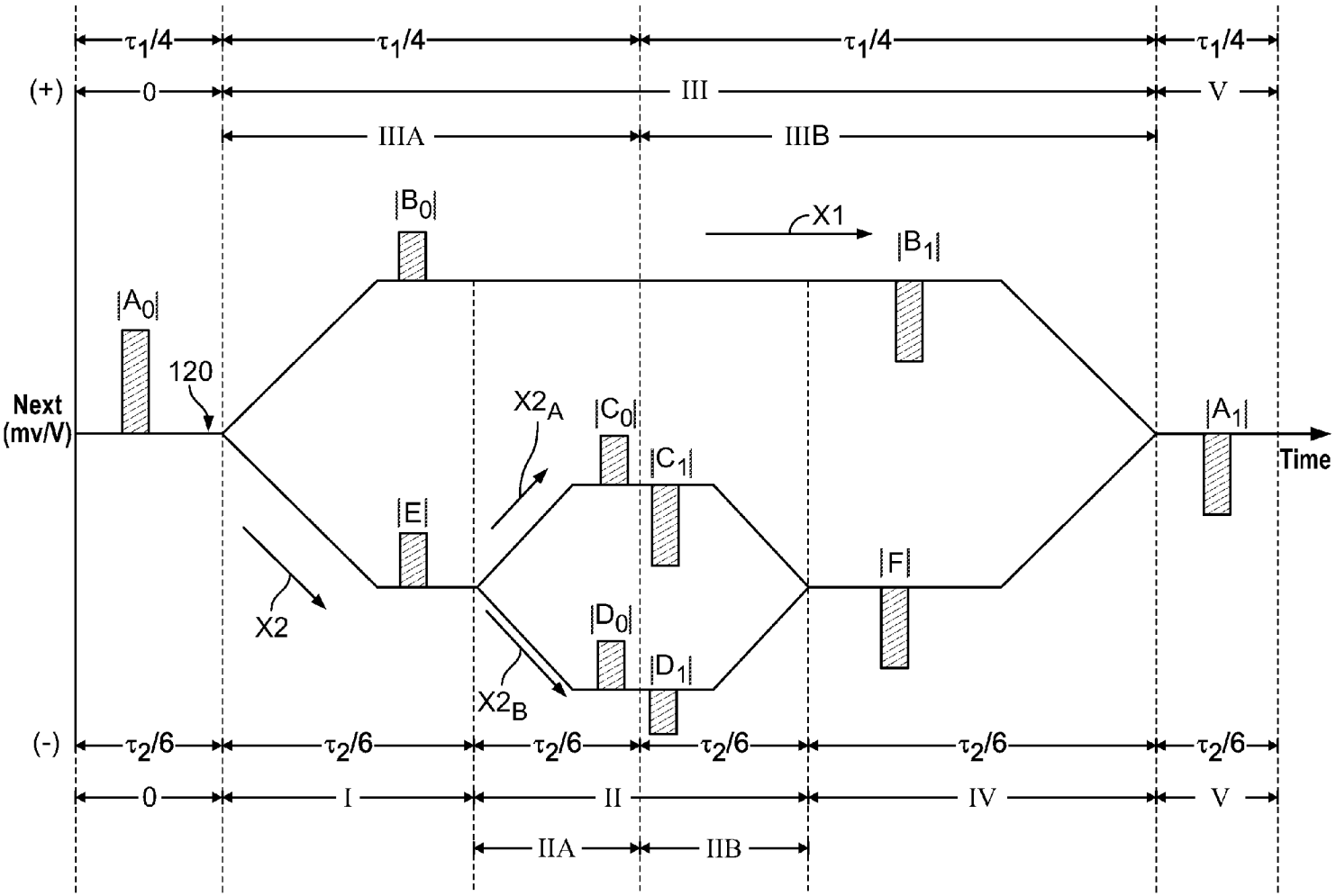
FIG. 9C illustrates polarity and magnitude as a function of transmission time delay for the embodiment shown in FIG. 9A.

FIG. 9C shows a NEXT polarity, magnitude, and time diagram of an exemplary embodiment of the electrical connector 100. The representative magnitude of NEXT stage 0 is $|A_0|$; the representative magnitude of stage I is $|E|$; the representative magnitude of stage IIA includes $|C_0|$ and $|D_9|$ the representative magnitude of stage IIB includes $|C_1|$ and $|D_1|$; the representative magnitude of stage IV is $|F|$; the representative magnitude of stage IIIA is $|B_0|$; the representative magnitude of stage IIIB is $|B_1|$; and the representative magnitude of stage V is $|A_1|$. The NEXT loss stages have a positive polarity and includes stages 0, I, IIA, and IIIA. The NEXT compensation stages have a negative polarity and include stages IIB, IIB, IV, and V. (Additional compensation stages, if used, may have a negative or positive polarity.) Thus, each NEXT stage is shown with a representative magnitude and polarity along the time axis.

Also shown, a representative time delay associated with each stage showing that the interconnection path X1, $\tau_1$, will be different than a time delay associated with the interconnection path X2, $\tau_2$, because of the asymmetric divisions of the interconnection paths X1 and X2. For example, $\tau_1$, is divided into $\tau_1 4$ as a signal flows through X1; whereas $\tau_2$ is divided into $\tau_2/6$ as a signal flows through stages 0, I, II, IV, and V in X2. As such, signal current flowing through interconnection path X1 will experience a time delay $\tau_1$, and signal current flowing through interconnection path X2, which further splits into $X2_A$ and $X2_B$, will experience a different time delay $\tau_2$. Accordingly, different phase shifts may be experienced along the interconnection paths X1 and X2.

Figure 9D:
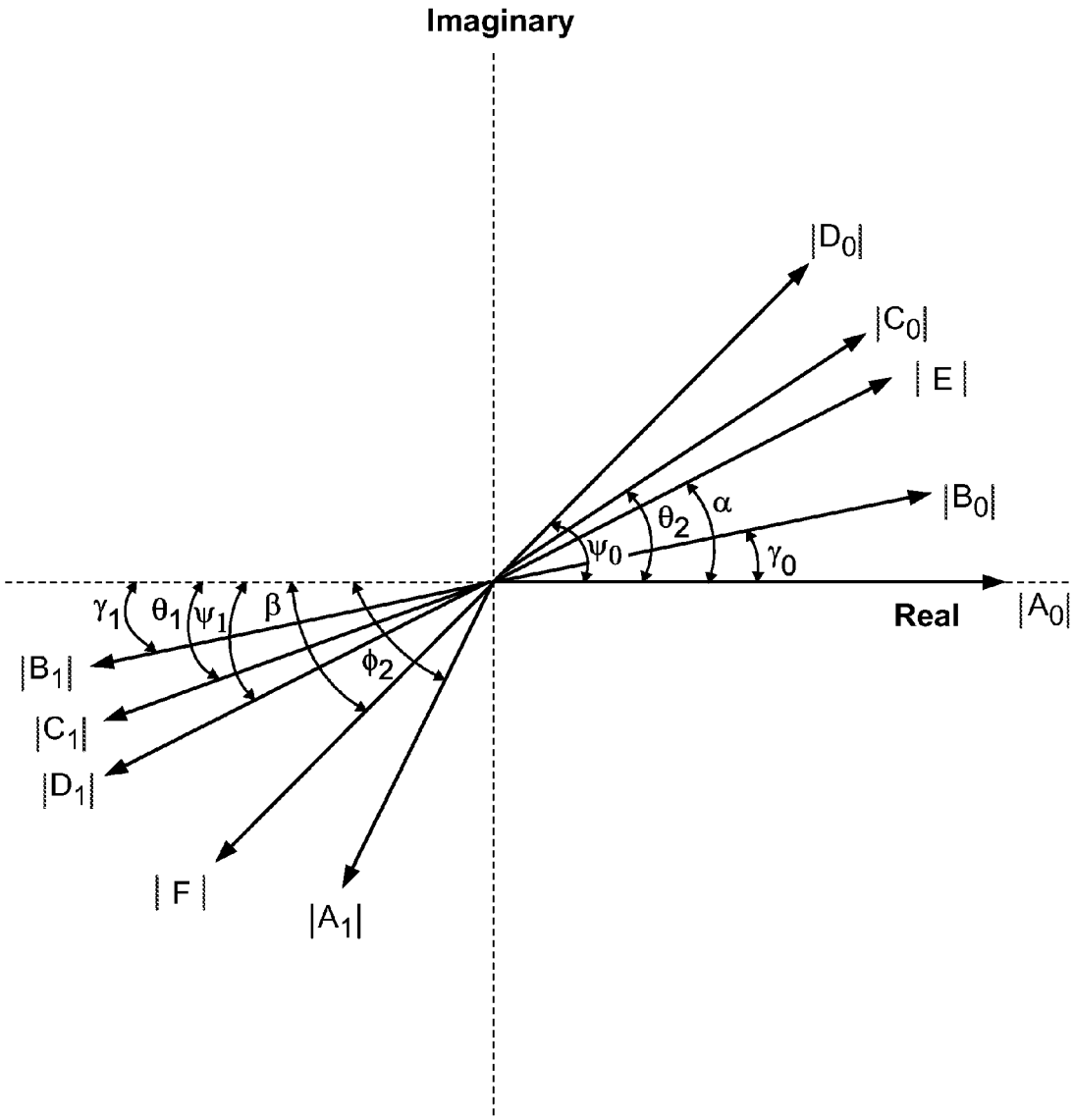
FIG. 9D illustrates a polarity and magnitude vector diagram of the embodiment shown in FIGS. 9A and 9C.

FIG. 9D is a graph illustrating the multiple complex vectors along the interconnection paths X1 and X2 on imaginary and real axes. As shown, the complex vectors are configured to approximately cancel each other out to reduce the negative effects of NEXT loss. Furthermore, compared to the graph shown in FIG. 6C, which illustrates a known compensation method along one interconnection path, the electrical configuration of the electrical connector 100 has more than one interconnecting path, i.e., interconnection paths X1 and X2, which may more effectively improve the electrical performance. In the illustrated embodiment, when the signal current is split between two or more interconnection paths, the offending signals generated by crosstalk near the mating interfaces may be compensated for through one or more NEXT compensation stages along each interconnection path where the polarity along each interconnection path is reversed only once. However, in alternative embodiments, the interconnection path may have multiple compensation stages where the polarity is reversed. Because the offending signals are split, the offending signals may be compensated for in a more efficient manner and the electrical connector can achieve better performance than compared to known connectors. For example, the magnitude of the offending NEXT loss is divided and isolated along each interconnection path thereby reducing the amount of compensation stages needed along each interconnection path to approximately cancel put the offending NEXT loss.

Thus, unlike prior art/techniques having multiple stages of compensation along a single interconnection path, the electrical connector 100 may provide multiple interconnection paths that each may provide one or more stages of compensation. When the interconnection paths are asymmetric, additional options and techniques are possible for providing compensation to the connector. Furthermore, because the signal current is split between interconnection paths, the electrical connector 100 may carry more power than other known electrical connectors.

In alternative embodiments, the interconnection paths X1 and X2 may be symmetric (i.e., the interconnection paths X1 and X2 may both have a common time delay associated with the electrical signal relative to $\vec{A}_0$). For example, the interconnection paths X1 and X2 may each have only one cross-over that occur at the same location where there is a common time delay associated with the electrical signal relative to $\vec{A}_0$.

Figure 10:
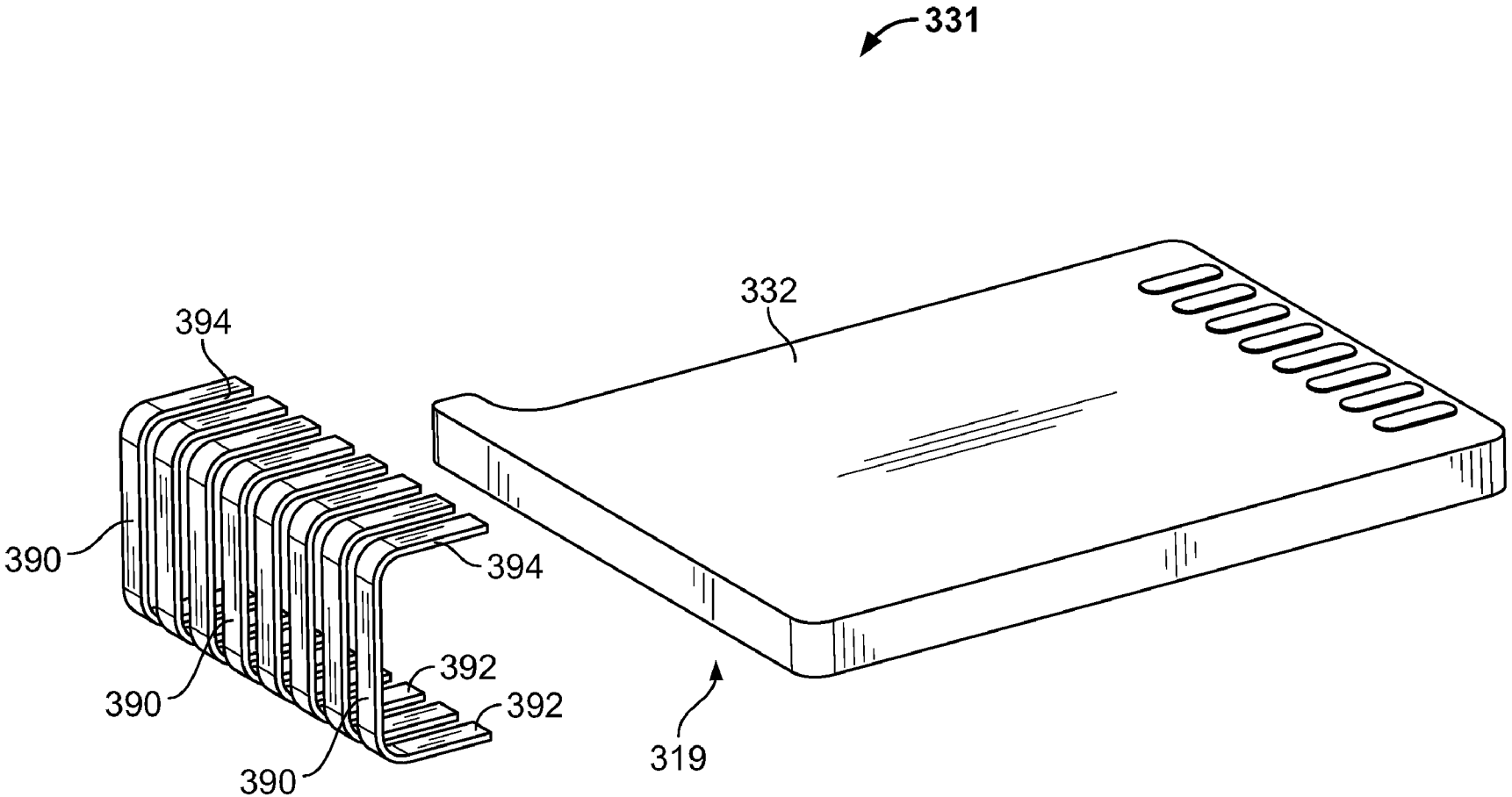
FIG. 10 is an exploded perspective view of a circuit board assembly including a plurality of rigid conductors in accordance with another embodiment.

FIG. 10 is a perspective view of an alternative circuit board assembly 331 that may be used with an electrical connector (not shown) formed in accordance with an alternative embodiment. The circuit board assembly 331 includes a circuit board 332 and may also include contact pads, traces, non-ohmic plates, and other features, such as those discussed above with respect to the circuit board assembly 132 (FIG. 7). Also shown, a plurality of connecting members 390 may be attached to a rear end 319 of the circuit board 332. The connecting members 390 are substantially rigid conductors that perform similar functions as the member traces 190 (FIG. 7) used with the connecting member 136 (FIG. 7). Each connecting member 390 has a board end portion 392 and a mating end portion 394. The board end portion 392 is configured to engage a contact pad (not shown) on a bottom of top surface of the circuit board 332, and the mating end portion 394 is configured to engage a conductor, such as the conductor 118 shown in FIG. 3.

Figure 11:
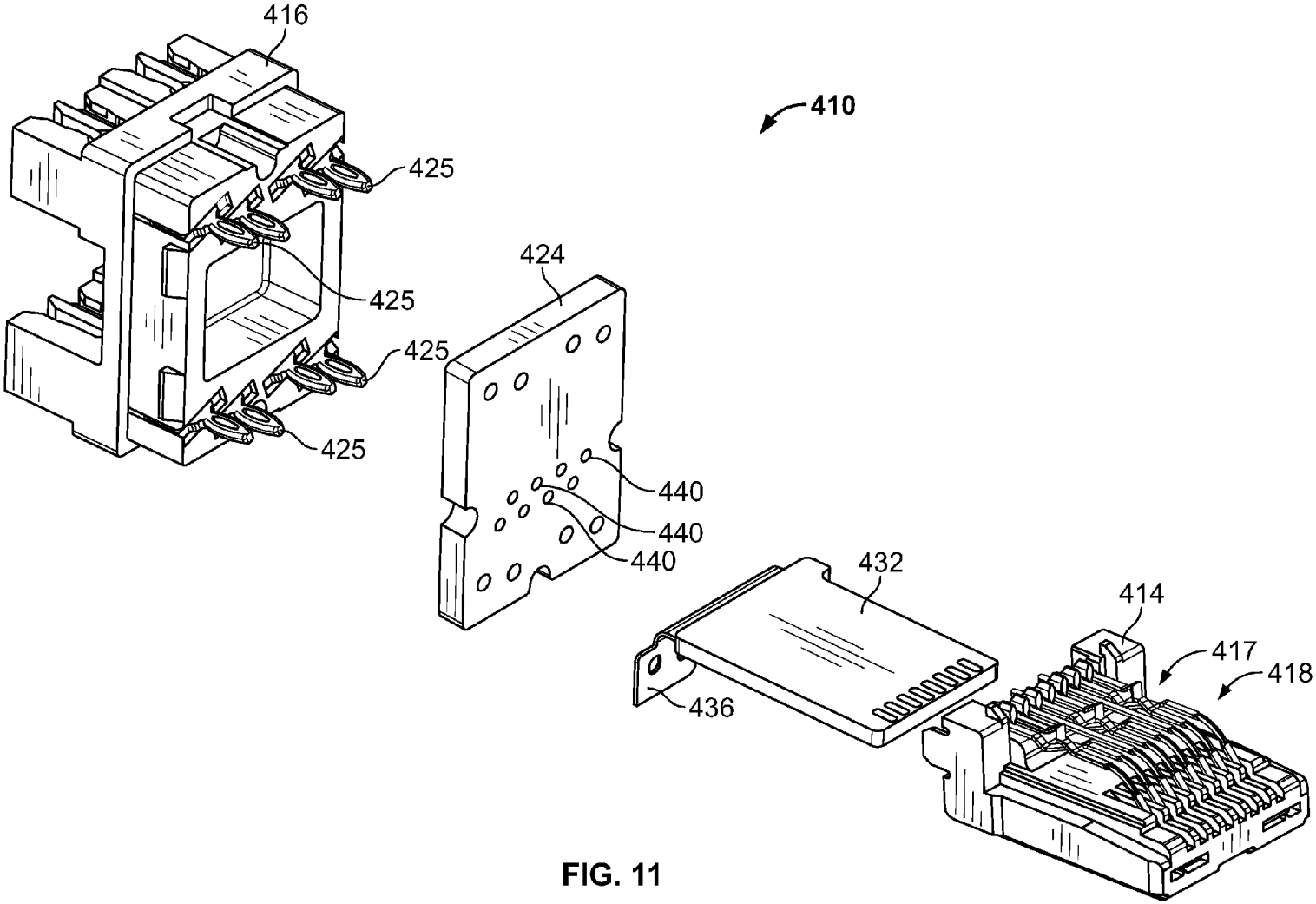
FIG. 11 is an exploded view of a contact sub-assembly formed in accordance with another embodiment.

FIG. 11 is ah exploded view of an alternative contact sub-assembly 410 that may be used with an electrical connector (not shown) formed in accordance with an alternative embodiment. The contact sub-assembly 410 may include a mating assembly 414 having an array 417 of conductors 418, a wire-terminating assembly 416, and circuit boards 424 and 432. The circuit boards 424 and 432 are both configured to be electrically connected to the plurality of conductors 418 disposed on the mating assembly 414. The contact sub-assembly 410 may be constructed similarly to the contact sub-assembly 110 (FIG. 2) discussed above. The circuit board 432 may have similar features as described above with respect to the circuit boards 152 and 332. The circuit board 432 includes a connecting member 436 which functions in a similar manner as in the connecting member 136. However, the connecting member 436 is configured to electrically couple to some of the IDC's 425 of the wire-terminating assembly 416. The conductors 418, in turn, are configured to engage corresponding pin-holes 440 of the circuit board 424. In such embodiments, a first interconnection path (not indicated) through the array 417 of conductor 418 may converge with a second interconnection path (not indicated) that travels through the circuit board 432 and joins the first interconnection path within the circuit board 424. Also, the connecting member 436 may be inserted into the circuit board 432 or, alternatively, the circuit board 432 may be formed around the connecting member 416 during the manufacturing of the circuit board 432.

Figure 12:
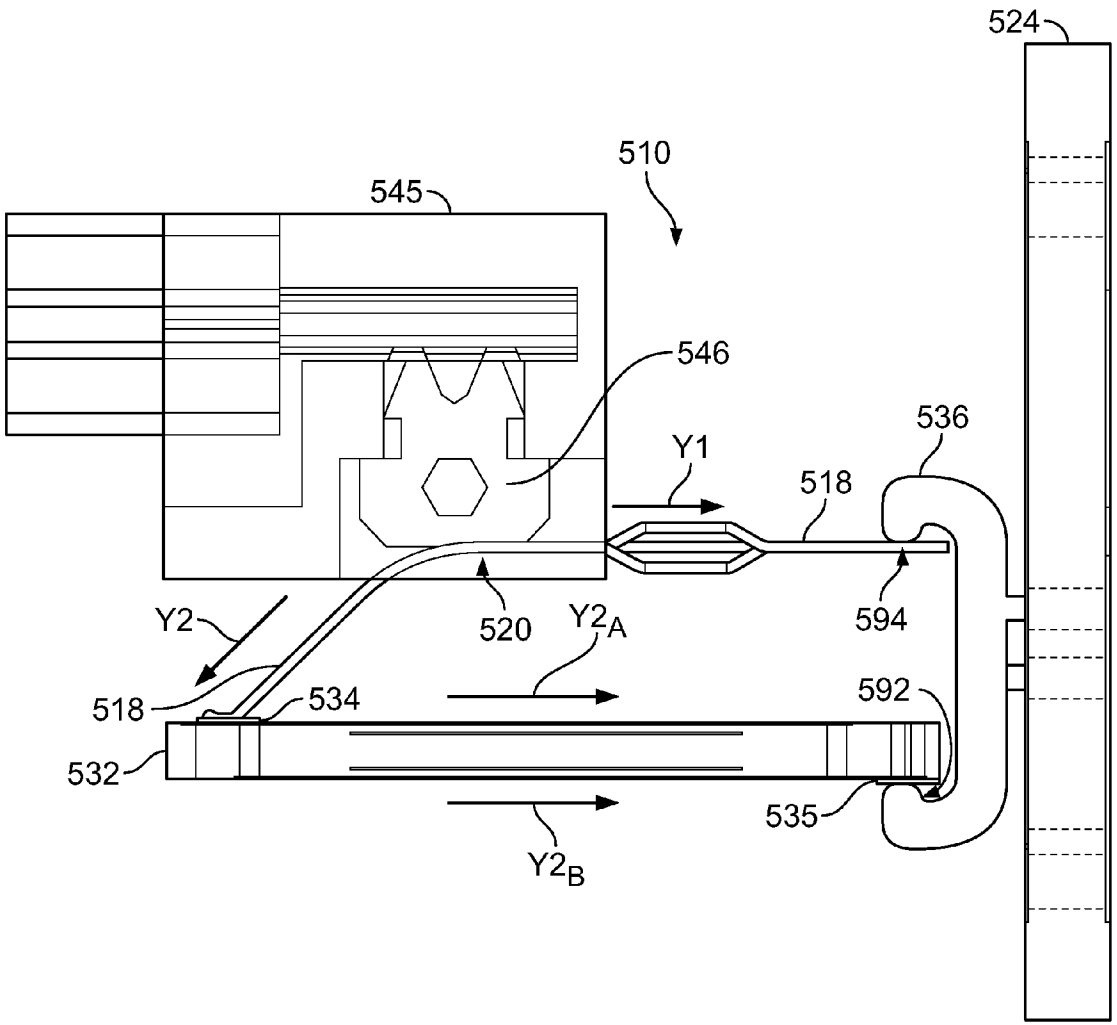
FIG. 12 is a schematic side view of a portion of an electrical connector formed in accordance with another embodiment while engaged with a modular plug.

FIG. 12 is a schematic side view of a portion of yet another contact sub-assembly 510 that may be used with an alternative embodiment of the electrical connector 100. The contact sub-assembly 510 may have similar features as described with respect to the contact sub-assembly 110 (FIG. 4). The contact sub-assembly 510 includes conductors 518 that engage mating contacts 546 of a modular plug 545 at an interface 520. The conductors 518 correspond to differential pairs that are electrically connected to traces (not shown)on a circuit board 532 through contact pads 534. The traces, in turn, are electrically connected to corresponding contact pads 535. In the illustrated embodiment, each contacts pad 535 and the corresponding conductor 518 electrically connected to one another via a connecting member 536. Each of the connecting members 536 includes a mating end portion 594 configured to engage one of the conductors 518 and a board end portion 592 configured to engage one of the contact pads 535. Also, each connecting member 536 is electrically connected to the circuit board 524. The connecting member 536 has a rigid body that is configured to grip or clamp onto the corresponding conductor 518 and contact pad 535.

As such, the contact sub-assembly 510 may provide multiple interconnection paths Y1 and Y2, where the interconnection paths Y1 and Y2 are either asymmetrically or symmetrically divided through the conductors 518 and through the circuit board 532. The interconnection paths Y1 and Y2 may join each other at the connecting members 536. Also, each interconnection path Y1 and Y2 may provide one or more stages of compensation. In one embodiment, the path Y2 has a higher impedance than the path Y1 such that a larger portion of the signal current travels through the path Y1.

As shown above, embodiments described herein may include electrical connectors that utilize multiple interconnection paths. Furthermore, embodiments described herein may include circuit boards and connectors the utilize non-ohmic plates that capacitatively and/or magnetically couple one more open-ended traces to one or more contact traces. The conductors, traces, and the non-ohmic plates may be configured to cause desired effects on the electrical performance. For example, with respect to the traces and non-ohmic plates, the areas of the plate surface and trace surfaces that face each other may be configured for a desired effect. The length of the non-ohmic plate, the widths of the plate and corresponding traces, the distance separating surfaces of the non-ohmic plate and corresponding traces, the distance separating the edges of the traces, and the length of the traces corresponding to the non-coupled portions may all be configured for desired effect. Thus, it is to be understood that the above description is intended to be illustrative, and not restrictive. As such, the above-described embodiments (and/or aspects thereof) may be used in combination with each other.

In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by on means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along, with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phase "means for" followed by a statement of function void of further structure.

What is claimed is:

1. An electrical connector configured to engage a mating connector having mating contacts and transmit a signal therebetween, the electrical connector comprising:

a housing having a mating end and a loading end;

an array of conductors comprising at least one differential pair of conductors extending between the mating end and the loading end within the housing and being configured to engage a selected mating contact at a mating interface, each conductor configured to transmit a signal current;

a plurality of traces extending between the mating end and the loading end, the traces being electrically connected to corresponding conductors proximate to at least one of the mating end and the loading end;

a first interconnection path formed by the conductors extending from the mating interface to the loading end; and a second interconnection path formed by the traces extending from the mating interface to the loading end;

wherein the signal current transmitting through at least one conductor of the at least one differential pair is split between the first and second interconnection paths and wherein at least one of the first and second interconnection paths is configured to provide compensation;

wherein the second interconnection path includes a plurality of secondary interconnection paths, the signal current transmitted through the second interconnection path being further split by the plurality of secondary interconnection paths and transmitting therethrough.

2. The electrical connector in accordance with claim 1 wherein the signal current is split asymmetrically between the first interconnection path and the second interconnection path.

3. The electrical connector in accordance with claim 1 wherein the conductors are configured to provide only one NEXT compensation stage along the first interconnection path.

4. The electrical connector in accordance with claim 1 wherein the traces are configured to provide a plurality of NEXT compensation stages along the second interconnection path where the NEXT compensation stages do not reverse in polarity.

5. The electrical connector in accordance with claim 1 further comprising:

a circuit board having the plurality of traces therein, the traces including at least one contact trace; and a connecting member electrically connected to the at least one contact trace and extending from the circuit board, the connecting member electrically connecting the contact trace to a corresponding conductor.

6. The electrical connector in accordance with claim 1 wherein the plurality of traces includes open-ended traces and contact traces and the at least one differential pair includes a first differential pair and a second differential pair, wherein the conductors of the first differential pair are electrically connected to open-ended traces and the conductors of the second differential pair are electrically coupled to contact traces.

7. The electrical connector in accordance with claim 1 wherein the plurality of traces include an open-ended trace and a contact trace, the open-ended and contact traces being positioned adjacent to each other to provide compensation.

8. The electrical connector in accordance with claim 7 further comprising a non-ohmic plate electromagnetically coupling the contact trace to the open-ended trace.

9. The electrical connector in accordance with claim 1 wherein the second interconnection path has a higher impedance than the first interconnection path.

10. The electrical connector in accordance with claim 1 wherein the first interconnection path does not split into a plurality of secondary interconnection paths thereby generating effectively different time delays for the first and second interconnection paths relative to each other.

11. The electrical connector in accordance with claim 1 wherein the secondary interconnection paths are reunited before the first and second interconnection paths are reunited.

12. An electrical connector configured to engage a mating connector having mating contacts and transmit a signal therebetween, the electrical connector comprising:

a housing having a mating end and a loading end;

an array of conductors comprising at least one differential pair of conductors extending between the mating end and the loading end within the housing, the conductors being configured to engage a selected mating contact at a mating interface and to transmit a signal current; and a circuit board assembly comprising:

a circuit board disposed within the housing between the mating end and the loading end;

a plurality of traces extending along the circuit board and including a signal trace that is electrically connected to a corresponding conductor proximate to the mating end; and a connecting member extending from the circuit board, the connecting member electrically connecting the signal trace to the corresponding conductor at a node proximate to the loading end, wherein a first current portion transmits through the corresponding conductor between the node and a corresponding mating interface and wherein a second current portion transmits through the signal trace and the connecting member between the node and the corresponding mating interface, the first and second current portions being joined at the node.

13. The electrical connector in accordance with claim 12 wherein the connecting member is embedded within the circuit board or bonded to the circuit board and extends therefrom.

14. The electrical connector in accordance with claim 12 wherein the connecting member includes member traces encased by a flexible material.

15. The electrical connector in accordance with claim 12 wherein the circuit board is a first circuit board and the electrical connector further comprises a second circuit board, the conductors being electrically connected to the second circuit board proximate to the loading end.

16. The electrical connector in accordance with claim 15 wherein the trace and the corresponding conductor are electrically connected to each other through the connecting member before the corresponding conductor is electrically connected to the second circuit board.

17. The electrical connector in accordance with claim 15 wherein the trace and the corresponding conductor are electrically connected to each other within the second circuit board through the connecting member.

18. The electrical connector in accordance with claim 15 wherein the second circuit board is oriented substantially perpendicular to the first circuit board.

19. An electrical connector configured to engage a mating connector having mating contacts and transmit a signal therebetween, the electrical connector comprising:

a housing having a mating end and a loading end;

an array of conductors comprising at least one differential pair of conductors extending between the mating end and the loading end within the housing, the conductors being configured to engage a selected mating contact at a mating interface and to transmit a signal current; and a circuit board assembly comprising:

a circuit board disposed within the housing between the mating end and the loading end;

a plurality of traces extending along the circuit board, at least one trace being electrically connected to a corresponding conductor proximate to the mating end; and a connecting member extending from the circuit board, the connecting member electrically connecting the at least one trace to the corresponding conductor proximate to the loading end;

wherein the conductors form a first interconnection path that extends from the mating interface to the loading end and the traces form a second interconnection path that extends from the mating interface to the loading end, wherein the signal current transmitting through at least one conductor of the at least one differential pair is split between the first and second interconnection paths.

20. The electrical connector in accordance with claim 19 wherein the first and second interconnection paths are configured to provide compensation.

21. The electrical connector in accordance with claim 19 wherein the signal current is split asymmetrically between the first interconnection path and the second interconnection path.

22. The electrical connector in accordance with claim 19 wherein the plurality of traces includes open-ended traces and contact traces and the at least one differential pair includes a first differential pair and a second differential pair, wherein the conductors of the first differential pair are electrically connected to open-ended traces and the conductors of the second differential pair are electrically coupled to contact traces.

23. An electrical connector configured to engage a mating connector having mating contacts and transmit a signal therebetween, the electrical connector comprising:

a housing having a mating end and a loading end;

an array of conductors comprising at least one differential pair of conductors extending between the mating end and the loading end within the housing, the conductors being configured to engage a selected mating contact at a mating interface and to transmit a signal current; and a circuit board assembly comprising:

a circuit board disposed within the housing between the mating end and the loading end;

a plurality of traces extending along the circuit board, at least one trace being electrically connected to a corresponding conductor proximate to the mating end; and a connecting member extending from the circuit board, the connecting member electrically connecting the at least one trace to the corresponding conductor(s) proximate to the loading end, wherein the connecting member includes at least one mating end portion and at least one board end portion, each board end portion attaching to a corresponding contact pad of the circuit board and each mating end portion engaging a corresponding conductor.

24. The electrical connector in accordance with claim 23 wherein the connecting member is a distinct component with respect to the at least one trace and the corresponding conductor.

25. The electrical connector in accordance with claim 23 wherein the connecting member includes a C-shaped body that defines a board-receiving space, a rear end of the circuit board being positioned within the board-receiving space.

* * * * *